US009033744B2

(12) United States Patent
Chen

(10) Patent No.: US 9,033,744 B2
(45) Date of Patent: May 19, 2015

(54) CARD EDGE CABLE CONNECTOR ASSEMBLY

(71) Applicant: Bing Xu Precision Co., Ltd., New Taipei (TW)

(72) Inventor: Chih-jung Chen, New Taipei (TW)

(73) Assignee: BING XU PRECISION CO., LTD., New Taipei (TW)

( * ) Notice: Subject to any disclaimer, the term of this patent is extended or adjusted under 35 U.S.C. 154(b) by 143 days.

(21) Appl. No.: 13/915,770

(22) Filed: Jun. 12, 2013

(65) Prior Publication Data

US 2013/0337699 A1 Dec. 19, 2013

(30) Foreign Application Priority Data

Jun. 15, 2012 (TW) ..... 101211542 A
Jun. 15, 2012 (TW) ..... 101211544 A

(51) Int. Cl.

| | |
|---|---|
| ***H01R 24/00*** | (2011.01) |
| ***H01R 12/72*** | (2011.01) |
| *H01R 12/57* | (2011.01) |
| *H01R 12/62* | (2011.01) |
| *H01R 12/70* | (2011.01) |
| *H01R 12/79* | (2011.01) |

(52) U.S. Cl.

CPC ..... *H01R 12/721* (2013.01); *H01R 12/57* (2013.01); *H01R 12/62* (2013.01); *H01R 12/7041* (2013.01); *H01R 12/79* (2013.01)

(58) Field of Classification Search

USPC ..... 439/660, 541.5, 607.23, 607.41, 941, 439/607.1, 630

See application file for complete search history.

(56) References Cited

U.S. PATENT DOCUMENTS

| | | | | |
|---|---|---|---|---|
| 7,540,786 | B1 * | 6/2009 | Koser et al. | 439/660 |
| 8,740,652 | B2 * | 6/2014 | Hsueh | 439/660 |
| 2008/0009197 | A1 * | 1/2008 | Lin | 439/660 |
| 2008/0305651 | A1 | 12/2008 | Mostoller et al. | |
| 2011/0217878 | A1 * | 9/2011 | Liu et al. | 439/630 |
| 2012/0015561 | A1 * | 1/2012 | Tsai | 439/660 |

FOREIGN PATENT DOCUMENTS

CN 101682136 A 3/2010

* cited by examiner

*Primary Examiner* — Jean F Duverne

(57) ABSTRACT

A card edge cable connector assembly is disclosed. The card edge cable connector assembly includes an insulating housing, a first circuit board, a cable, and a cover. The insulating housing includes inserted a plurality of first terminals and a plurality of second terminals, where the first terminals and the second terminals can be electrically connected to the cable via the first circuit board. The first terminals are above the second terminals, and contacts of the first terminals, and mating portions of the first terminals and mating portions of the second terminals stretch into a plug space of the insulating housing. The plug space can be used for a second circuit board to plug in such that the first terminals and the second terminals electrically contact to the second circuit board.

20 Claims, 33 Drawing Sheets

CARD EDGE CABLE CONNECTOR ASSEMBLY

BACKGROUND OF THE INVENTION

1. Field of the Invention

The invention relates to a card edge cable connector assembly, and more particularly, to a card edge cable connector assembly electrically connected to a circuit board, comprising a cable and a plug space such that when the card edge portion of the circuit board is inserted into the plug space, the circuit board and the cable can be electrically connected to each other.

2. Description of the Prior Art

As disclosed in China Patent CN101682136, a card edge cable connector is a connector used for connecting a cable to a card edge interface. The card edge cable connector comprises a housing having a first surface and a second surface opposite to the first surface. The two surfaces separate the seam groove. The bifurcate contacting units are positioned inside the housing, where each contacting unit comprises naked a first bifurcate tooth portion, a second bifurcate tooth portion, a connecting board portion for connecting the first and the second bifurcate tooth portions, and a cable connecting portion for connecting the conductors of a cable.

However, in the aforementioned prior art, only the first bifurcate tooth portion is used as a contact for being connected to a printed circuit board (PCB). The second bifurcate tooth portion is merely used as a fixing end. Therefore, the current card edge cable connector only has a single row of contacts on the top of the connector. When more contacts are needed, the thickness of the PCB will be increased and the entire volume of the card edge connector will be increased. In addition, if the width of PCB is not increased, the both sides of the PCB should be able to be electrically connected and contacts should be positioned both on the top and the bottom of the card edge cable connector to form two rows of contacts. Therefore, the current card edge connector should be improved.

SUMMARY OF THE INVENTION

It is therefore one of the primary objectives of the claimed invention to provide a to a card edge cable connector assembly electrically connected to a circuit board, comprising a cable and a plug space such that when the card edge portion of the circuit board is inserted into the plug space, the circuit board and the cable can be electrically connected to each other.

The first advantage of the present invention is to add a plurality of second terminals in addition to the first terminals. However, the contacts of the first terminals and the contacts of the second terminals are positioned as two rows, which are respectively on the top and the bottom. Therefore, the width of the insulating housing can be optimally small.

The second advantage of the present invention is that the first terminals and the second terminals can be electrically connected to a line transmission device via the first circuit board and the height of the first circuit board is less than or equal to the height of the insulating housing. Therefore, the height of the insulating housing can be optimally small.

The third advantage of the present invention is that the first side and the second side of the insulating housing have different thickness, and only the first side can be inserted into the groove of the second circuit board to achieve a fool-proof design.

The fourth advantage of the present invention is that when the card edge cable connector assembly or the second circuit board is shocked, the line transmission device can be used as a buffer. Furthermore, if the card edge cable connector assembly or the second circuit board is collided by an external force, the line transmission device can be used as a buffer to prevent the second circuit board from being damaged.

The fifth advantage of the present invention is that the first terminals and the second terminals can have a tilted angle such that when the ends of the first terminals and the second terminals are soldered on the first circuit board, more solder can enter the space between the ends of the first terminals and the second terminals.

According to the present invention, a card edge cable connector assembly comprises: an insulating housing, comprising a plurality of first terminal holes, a plurality of second terminal holes, and a plurality of grooves; a first circuit board, comprising a plurality of first soldering portions, a plurality of second soldering portions, and a plurality of contacts; a plurality of first terminals, fastened in the grooves of the insulating housing, and ends of the first terminals are soldered together with the first soldering portions of the first circuit board; a plurality of second terminals, fastened in the grooves of the first insulating housing, and ends of the second terminals are soldered together with the second soldering portions of the first circuit board; a line transmission device, comprising a plurality of conductors electrically connected to the contacts of the first circuit board; and a cover, secured to an end of the insulating housing. The insulating housing further comprises a plug space. The first terminal holes are located on a top of the plug space. The second terminal holes are located on a bottom of the plug space. Mating portions of the first terminals stretch into the plug space via the first terminal holes, and mating portions of the second terminals stretch into the plug space via the second terminal holes.

In one aspect of the present invention, the first terminals are above the second terminals, and the mating portions of the first terminals and the mating portions of the second terminals are interlaced.

In another aspect of the present invention, glue is spread on the contacts of the first circuit board and a front of the line transmission device, and the front of the line transmission device has a bending angle.

In another aspect of the present invention, the cover comprises a pair of piercers, for securing a pair of roots, and the cover further comprises a notch, wherein the line transmission device is capable of stretching outside via the notch.

In another aspect of the present invention, the cover comprises a rectangular frame, the first circuit board is limited inside the rectangular frame, and the cover further comprises a rectangular hole, and the line transmission device is capable of stretching outside via the rectangular hole.

In another aspect of the present invention, the card edge cable connector assembly further comprises a pulling band positioned on the insulating housing or the cover. The insulating housing comprises a positioning block on a first side, and a pair of guiding blocks on a front end.

In another aspect of the present invention, the card edge cable connector assembly further comprises a second circuit board comprising a card edge portion. The card edge portion comprises a plurality of contacts on a front and a back of the card edge portions. The card edge portion is capable of being plugged into the plug space of the insulating housing and the mating portions of the first terminals are capable of electrically connected to the contacts on the front of the card edge portion. The mating portions of the second terminals are capable of being electrically connected to the contacts on the back of the card edge portion.

In another aspect of the present invention, a thickness of a first side of the insulating housing is less than a thickness of a second side of the insulating housing.

In another aspect of the present invention, the second circuit board comprises a groove and a positioning portion. A first side of the insulating housing is capable of being inserted into the groove of the second circuit board, and the positioning block is capable of being secured to the positioning portion of the second circuit board.

In another aspect of the present invention, the line transmission device is a flex flat cable, a flexible printed circuit board, or a wire cable.

According to the present invention, a card edge cable connector assembly comprises: an insulating housing, comprising a plurality of first terminal holes, a plurality of second terminal holes, and a plurality of grooves; a first circuit board, comprising a plurality of first soldering portions, a plurality of second soldering portions, and a plurality of contacts; a plurality of first terminals, comprising a plurality of vertical roots fastened in the grooves of the insulating housing, and ends of the first terminals are soldered together with the first soldering portions of the first circuit board; a plurality of second terminals, comprising a plurality of vertical roots fastened in the grooves of the first insulating housing, and ends of the second terminals are soldered together with the second soldering portions of the first circuit board; a line transmission device, comprising a plurality of conductors electrically connected to the contacts of the first circuit board; and a cover, secured to an end of the insulating housing. The insulating housing further comprises a plug space. The first terminal holes are located on a top of the plug space. The second terminal holes are located on a bottom of the plug space. Mating portions of the first terminals stretch into the plug space via the first terminal holes. Mating portions of the second terminals stretch into the plug space via the second terminal holes.

In one aspect of the present invention, the first terminals and the second terminals are blanking terminals. The vertical roots of the first terminal and the second terminals are fastened in the grooves of the insulating housing by utilizing a pair of reversed spikes, the grooves comprises stretched grooves, and the ends of the first terminals and the second terminals are located in the stretched grooves.

In another aspect of the present invention, the line transmission device is a flex flat cable or a flexible printed circuit board, a glue is spread on the contacts of the first circuit board and a front of the line transmission device, and the front of the line transmission device has a bending angle.

In another aspect of the present invention, the cover comprises a rectangular frame, the first circuit board is limited inside the rectangular frame, and the cover further comprises a rectangular hole, and the line transmission device is capable of stretching outside via the rectangular hole.

In another aspect of the present invention, the card edge cable connector assembly further comprises: a pulling band positioned on the insulating housing or the cover. The insulating housing comprises a positioning block on a first side, and a pair of guiding blocks on a front end.

In another aspect of the present invention, the card edge cable connector assembly further comprises a second circuit board, comprising a card edge portion, a groove, and a positioning portion. The card edge portion comprises a plurality of contacts on a front and a back of the card edge portions, and is capable of being plugged into the plug space of the insulating housing. The mating portions of the first terminals are capable of electrically connected to the contacts on the front of the card edge portion, the mating portions of the second terminals are capable of being electrically connected to the contacts on the back of the card edge portion, a first side of the insulating housing is capable of being inserted into the groove of the second circuit board, and a positioning block is capable of being secured to the positioning portion of the second circuit board.

According to the present invention, a card edge cable connector assembly comprises: an insulating housing, comprising a plurality of first terminal holes, a plurality of second terminal holes, and a plurality of grooves; a first circuit board, comprising a plurality of first soldering portions, a plurality of second soldering portions, and a plurality of contacts; a plurality of first terminals, comprising a plurality of vertical roots fastened in the grooves of the insulating housing, and ends of the first terminals are soldered together with the first soldering portions of the first circuit board; a plurality of second terminals, comprising a plurality of vertical roots fastened in the grooves of the first insulating housing, and ends of the second terminals are soldered together with the second soldering portions of the first circuit board; a line transmission device, comprising a plurality of conductors electrically connected to the contacts of the first circuit board; and a covering body, positioned in an end of the insulating housing and a front of the line transmission device in an over-molding way. The insulating housing further comprises a plug space. The first terminal holes are located on a top of the plug space, the second terminal holes are located on a bottom of the plug space. Mating portions of the first terminals stretch into the plug space via the first terminal holes, and mating portions of the second terminals stretch into the plug space via the second terminal holes.

In one aspect of the present invention, the first terminals and the second terminals are blanking terminals. the vertical roots of the first terminal and the second terminals are fastened in the grooves of the insulating housing by utilizing a pair of reversed spikes, the grooves comprises stretched grooves, and the ends of the first terminals and the second terminals are located in the stretched grooves.

In another aspect of the present invention, the card edge cable connector assembly further comprises: a pulling band positioned on the insulating housing or the cover, wherein the insulating housing comprises a positioning block on a first side, and a pair of guiding blocks on a front end.

In another aspect of the present invention, the card edge cable connector assembly further comprises a second circuit board, comprising a card edge portion, a groove, and a positioning portion, wherein the card edge portion comprises a plurality of contacts on a front and a back of the card edge portions, and is capable of being plugged into the plug space of the insulating housing. The mating portions of the first terminals are capable of electrically connected to the contacts on the front of the card edge portion, the mating portions of the second terminals are capable of being electrically connected to the contacts on the back of the card edge portion, a first side of the insulating housing is capable of being inserted into the groove of the second circuit board, and a positioning block is capable of being secured to the positioning portion of the second circuit board.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

Figure 1:
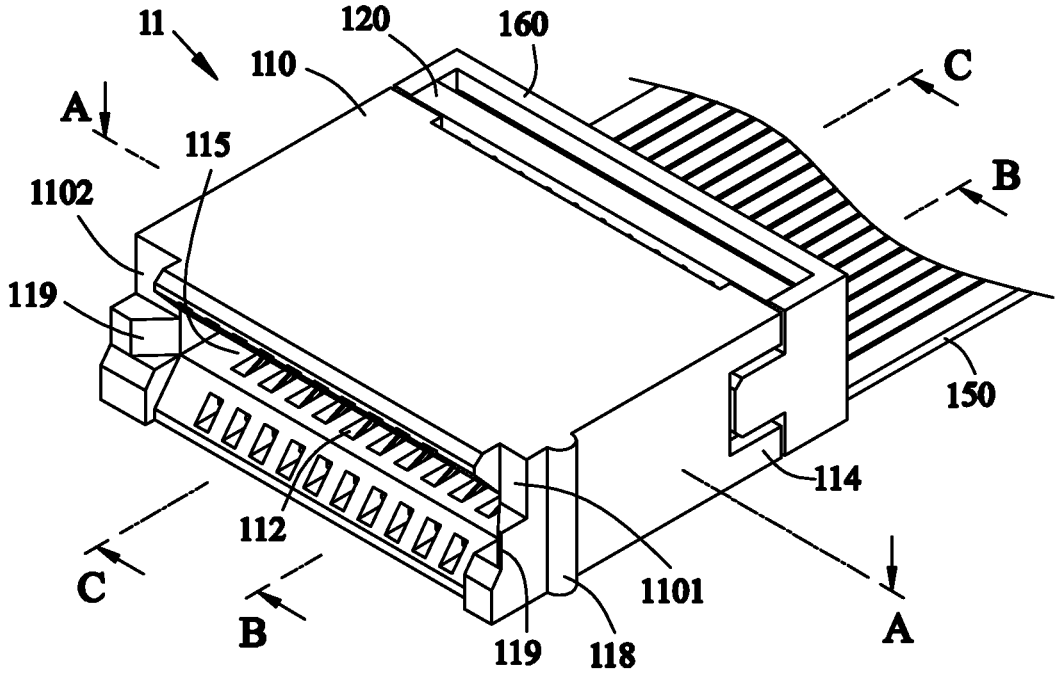
FIG. 1 is a diagram showing a card edge connector assembly according to a preferred embodiment of the present invention.

Please refer to FIG. 1-FIG. 6. In a preferred embodiment, the card edge connector assembly 11 comprises an insulating housing 110, a first circuit board 120, a plurality of first terminals 130, a plurality of second terminals 140, a line transmission device 150 and a cover 160. The insulating housing 110 comprises a plurality of first terminal holes 111, a plurality of second terminal holes 112, and a plurality of grooves 113. The first circuit board 120 comprises a plurality of first soldering portions 121, a plurality of second soldering portions 122, and a plurality of contacts 123. The first terminals 130 are fastened in the grooves 113 of the insulating housing 110 (ex: piercer 133 fastened in the groove 113). The ends 135 of the first terminals 130 are soldered on the first soldering portions 121 of the first circuit board 120. The second terminals 140 are fastened in the grooves 113 of the insulating housing 110 (ex: piercer 143 fastened in the groove 113). The ends 145 of the second terminals 140 are soldered on the second soldering portions 122 of the first circuit board 120. The line transmission device 150 can be a flex flat cable or a flexible printed circuit board. The transmission device 150 comprises an insulating layer 152, which covers a plurality of conductors 153. The conductors 153 are electrically connected to the contacts 123 of the first circuit board 120. The cover 160 is secured to the end 114 of the insulating housing 110. The insulating housing 110 comprises a plug space 115. The first terminal holes 111 are located at the top of the plug space 115. The second terminal holes 112 are located at the bottom of the plug space 115. The mating portions 131 of the first terminals 130 stretch into the plug space 115 via the first terminal holes 111, and the mating portions 141 of the second terminals 140 stretch into the plug space 115 via the second terminal holes 112. Please note, the present invention add the second terminals in addition to the first terminals 130, however, the mating portions 131 and the mating portions 141 are arranged as two rows respectively positioned on the top and the bottom. Therefore, the width of the insulating housing 110 can be optimally small. Furthermore, the first terminals 130 and the second terminals 140 are electrically connected to the line transmission device 150 via the first circuit board 120, and the height of the first circuit board 120 is less than or equal to the height of the insulating housing 110. Therefore, the height of the insulating housing can be optimally small.

The arrangement of the first terminals 130 and the second terminals 140 are illustrated as follows: the first terminals 130 and the second terminals 140 can be inserted via the end 114 of the insulating housing 110 and fastened inside the insulating housing 110. The first terminals 130 are positioned above the second terminals, and the mating portions 131 of the first terminals and the mating portions 141 of the second terminals 140 can be interlaced as shown in FIG. 1-FIG. 4.

Figure 2:
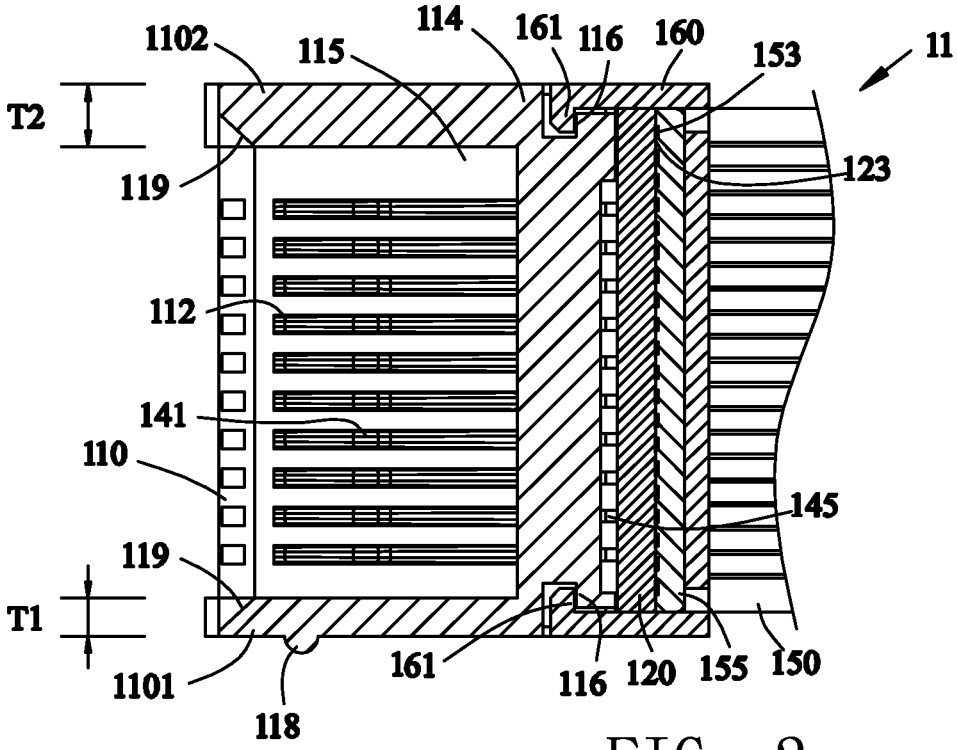
FIG. 2 is a cross view along A-A line shown in FIG. 1.

The fool-proof structure of the card edge cable connector 11 is illustrated as follows: the first side 1101 and the second side 1101 of the insulating housing 110 have different thickness. That is, the thickness T1 of the first side 1101 is less than the thickness T2 of the second side 1102 such that the insulating housing 110 can have the fool-proof effect as shown in FIG. 2.

Figure 3:
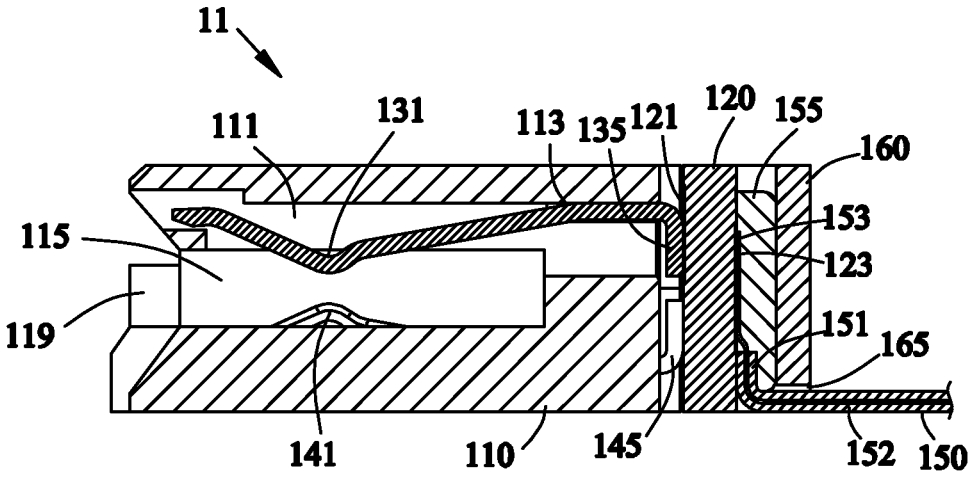
FIG. 3 is a cross view along B-B line shown in FIG. 1.
Figure 4:
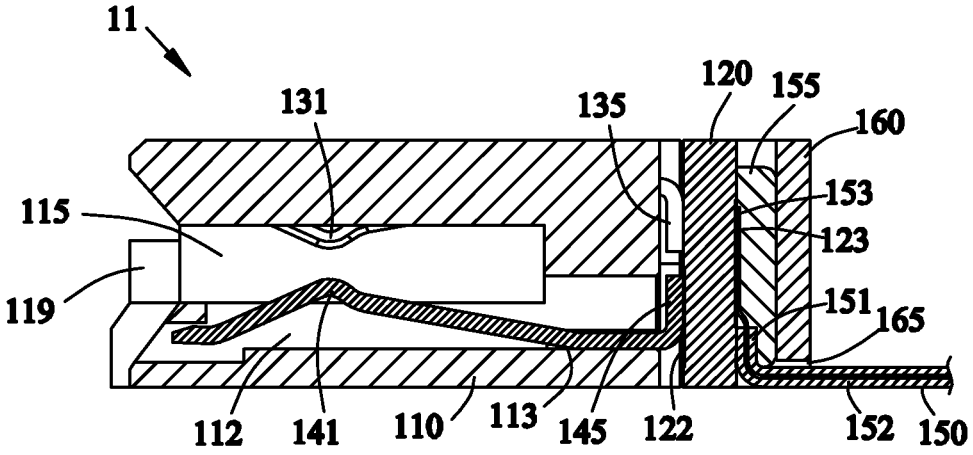
FIG. 4 is a cross view along C-C line shown in FIG. 1.
Figure 5:
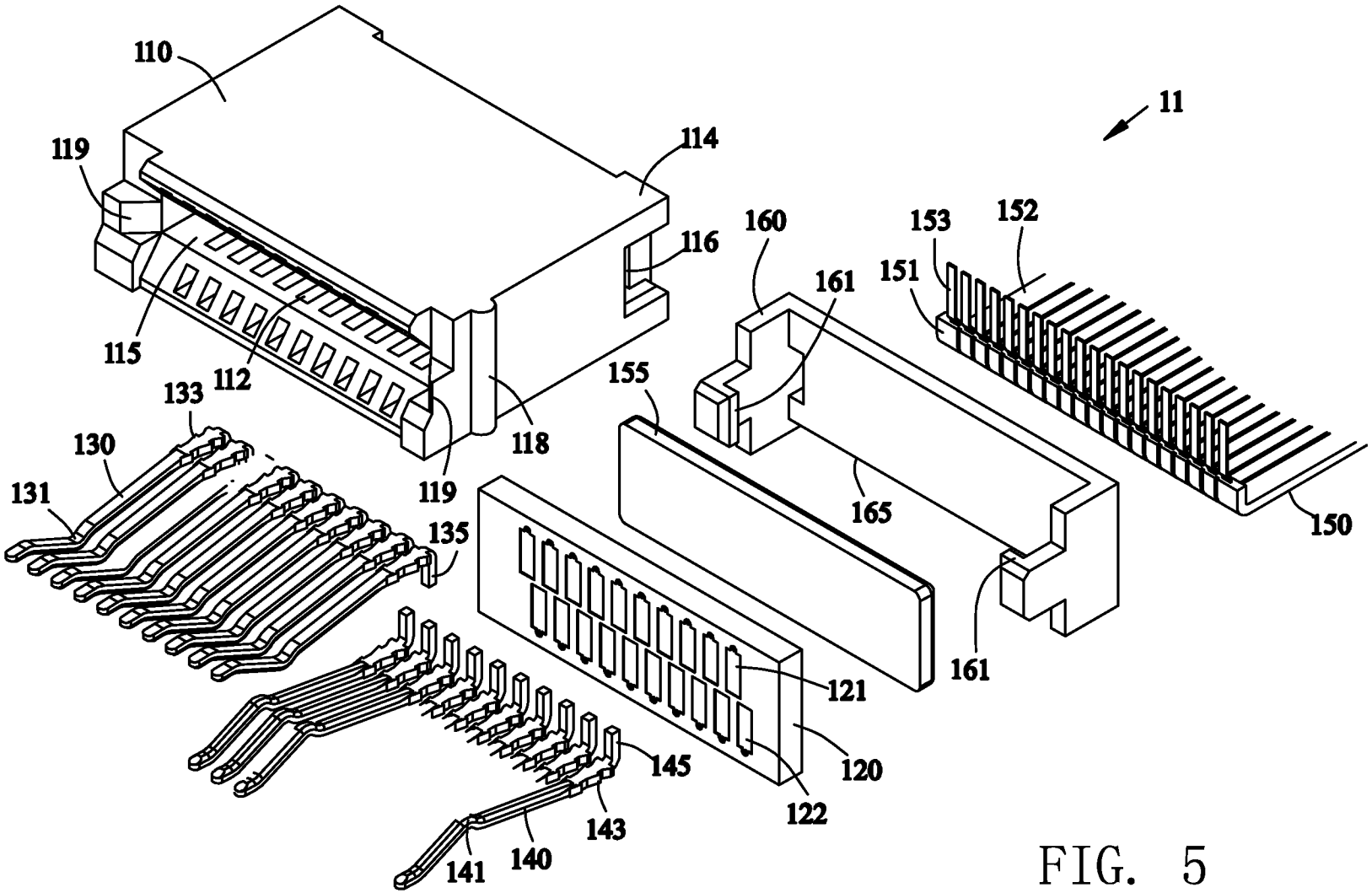
FIG. 5 is an explosion diagram (1) of a preferred embodiment.
Figure 6:
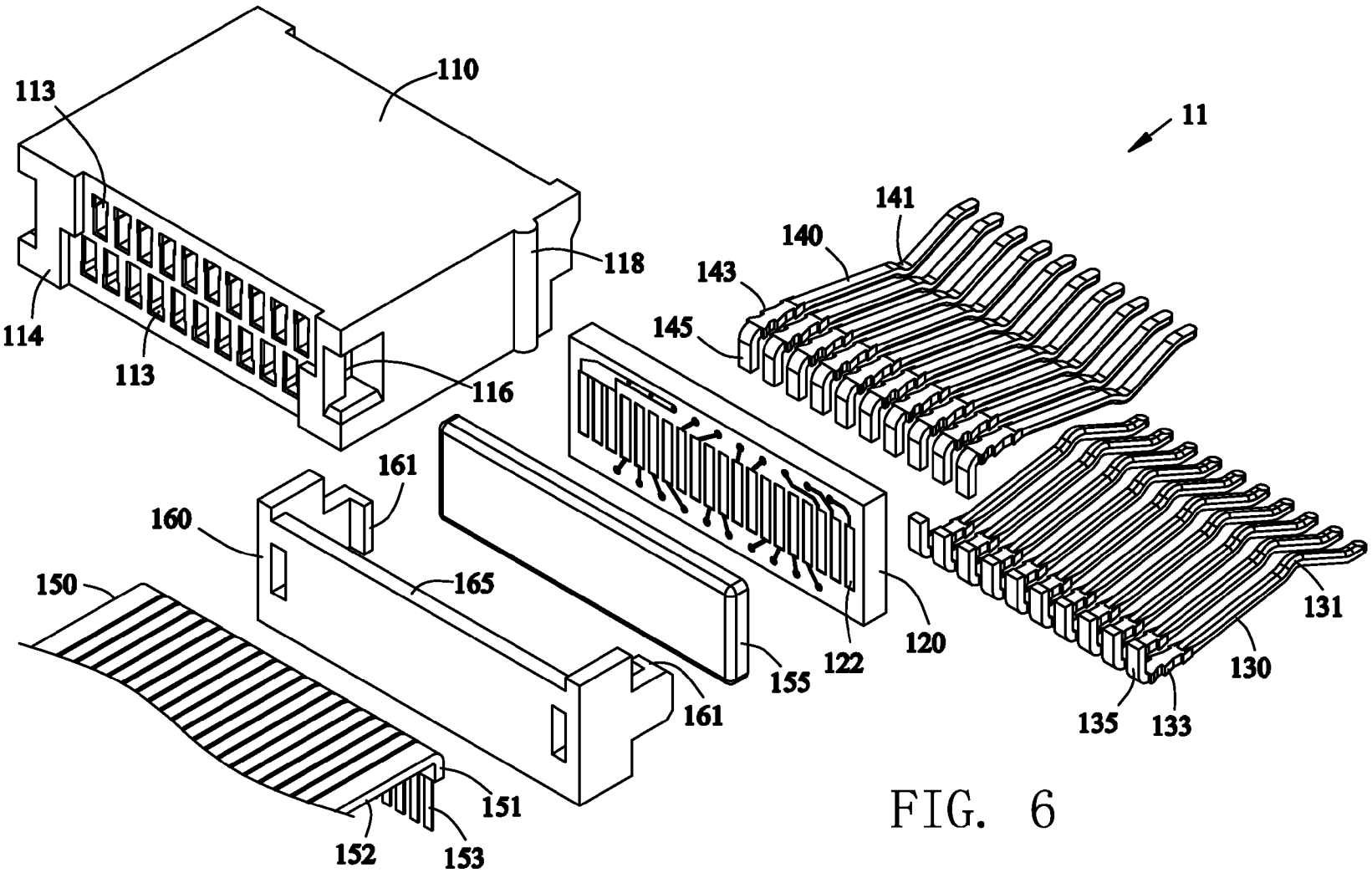
FIG. 6 is an explosion diagram (2) of a preferred embodiment.

The protection of the first circuit board 120 and the line transmission device 150 is illustrated as follows: glue 155 is spread on the contacts 123 of the first circuit board 120 and the fronts 151 of the line transmission device 150, and the fronts 151 of the line transmission 150 has a bending angle as shown in FIG. 3-FIG. 4.

The fixing mechanism of the cover 160 and the insulating housing 110 is illustrated as follows: the cover 160 utilizes a pair of piercers 161 to secure a pair of positioning portions 116 of the insulating housing 110. Furthermore, the cover 160 comprises a notch 165. The line transmission device 150 can stretch outside via the notch 165 as shown in FIG. 3-FIG. 6.

Please refer to FIG. 7-FIG. 11. In a second embodiment, the card edge cable connector assembly 11 further comprises a pulling band 117 and a second circuit board 170 (ex: a circuit board of a hard disk, an optical disk drive, or any other electronic devices). The pulling band 117 can be fixed on the insulating housing 110. Or, the pulling band 117 can be fixed on the cover 160. The first side 1101 of the insulating housing 110 has a positioning block 118, and the front of the insulating housing 110 has a pair of guiding blocks 119. The first circuit board 170 comprises a card edge portion 171. The front 1711 and the back 1712 of the card edge portion 171 comprises a plurality of contacts 173 and 174. The card edge portion 171 can be plugged into the plug space 115 of the insulating housing 110 according to the guiding mechanism of the guiding blocks 119. In addition, the mating portions 131 of the first terminals 130 can be electrically contacted to the contacts 173 of the front 1711 of the card edge portion 171, and the mating portions 141 of the first terminals 140 can be electrically contacted to the contacts 174 of the front 1712 of the card edge portion 171. In this way, when the card edge cable connector assembly 11 or the second circuit board 170 are shocked, the line transmission device 150 can be used as a buffer. When the card edge cable connector assembly 11 or the second circuit board 170 are collided by an external force, the line transmission device 150 can be used as a buffer for prevent the second circuit board 170 from being damaged.

The positioning mechanism of the insulating housing 110 and the second circuit board 170 is illustrated as follows: the second circuit board 170 can further comprise a groove 175 and a positioning portion 176. The first side 1101 of the first insulating housing 110 can be inserted into the groove 175 of the second circuit board 170, and the positioning block 118 of the insulating housing 110 can be secured to the positioning portion 176 of the second circuit board 176. In this way, the corresponding position of the insulating housing 110 and the second circuit board 170 can be determined.

Figure 7:
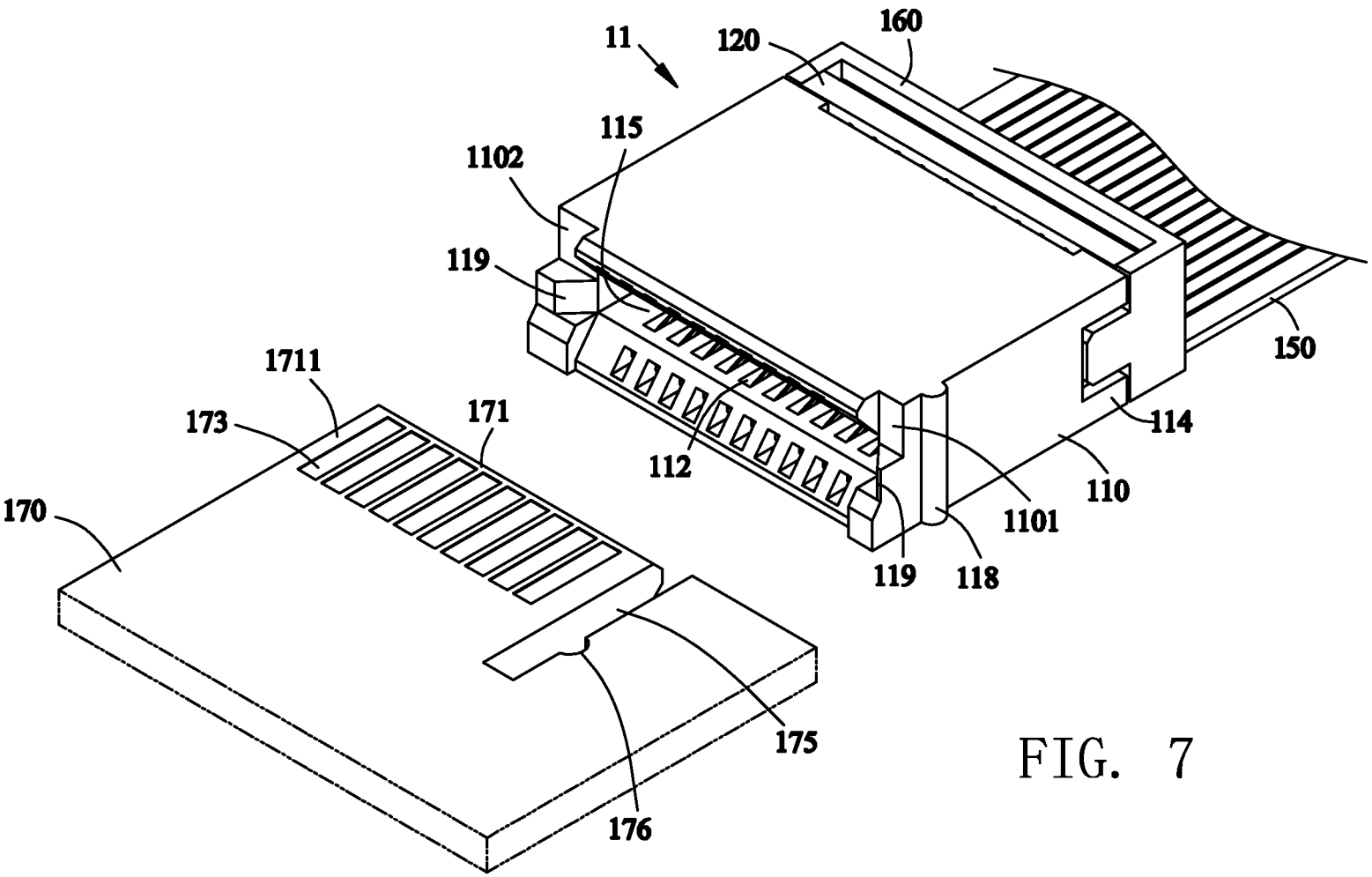
FIG. 7 is a partial explosion diagram (1) of a second embodiment.
Figure 8:
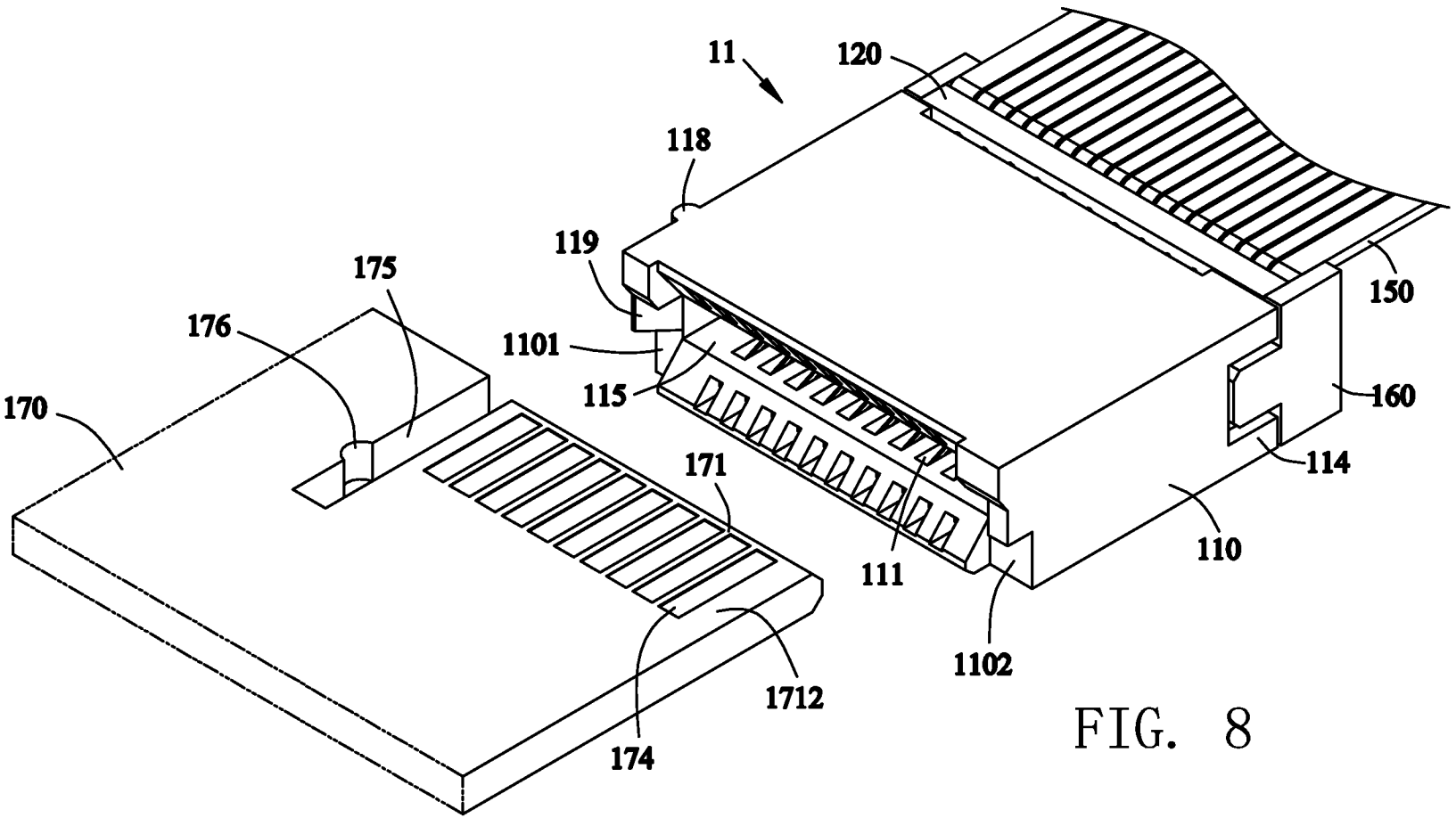
FIG. 8 is a partial explosion diagram (2) of a second embodiment.
Figure 9:
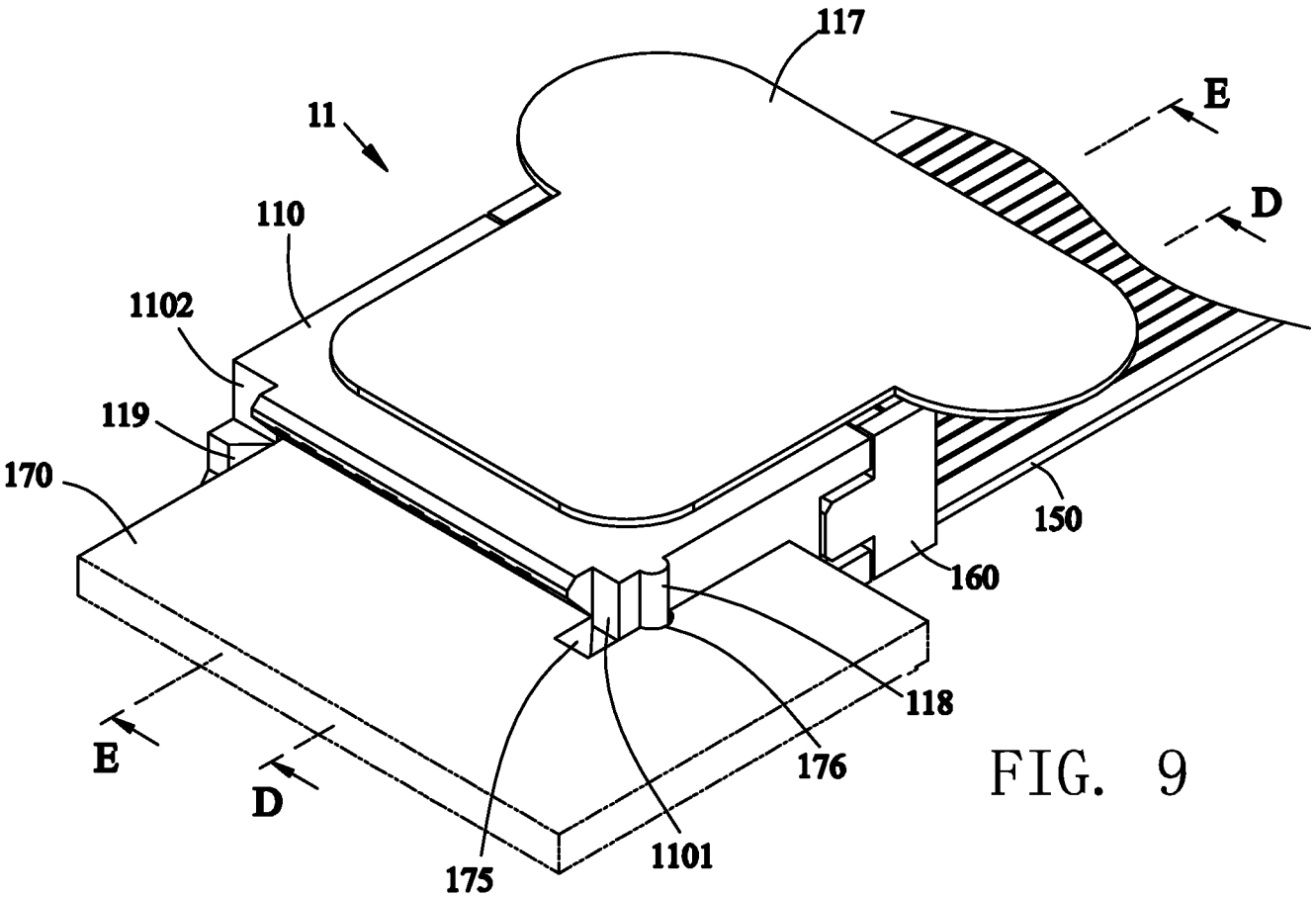
FIG. 9 is a diagram showing a card edge connector assembly according to a second embodiment of the present invention.
Figure 10:
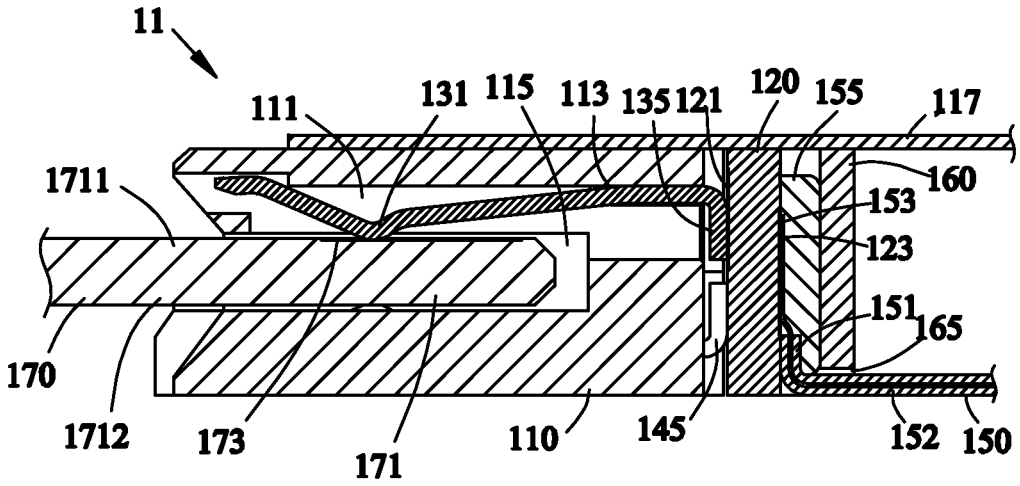
FIG. 10 is a cross view along D-D line shown in FIG. 9.
Figure 11:
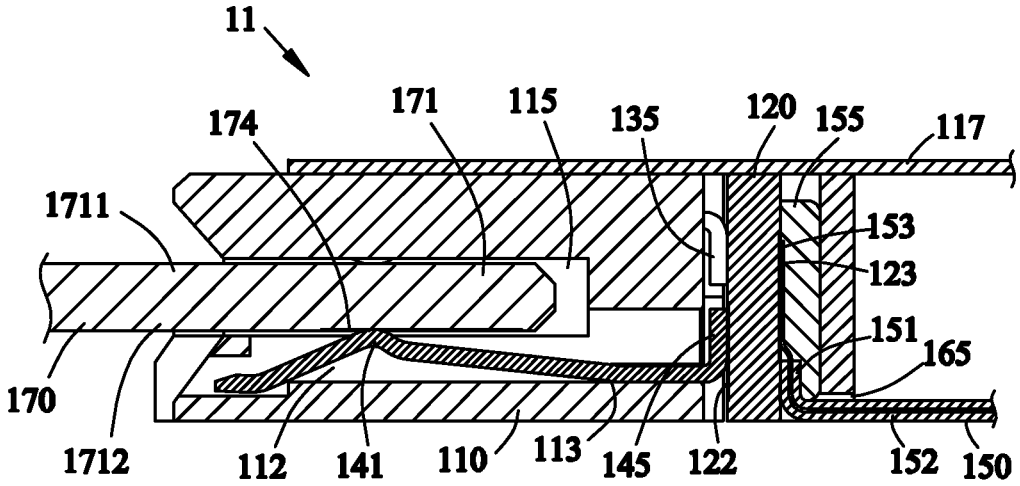
FIG. 11 is a cross view along E-E line shown in FIG. 9.
Figure 12:
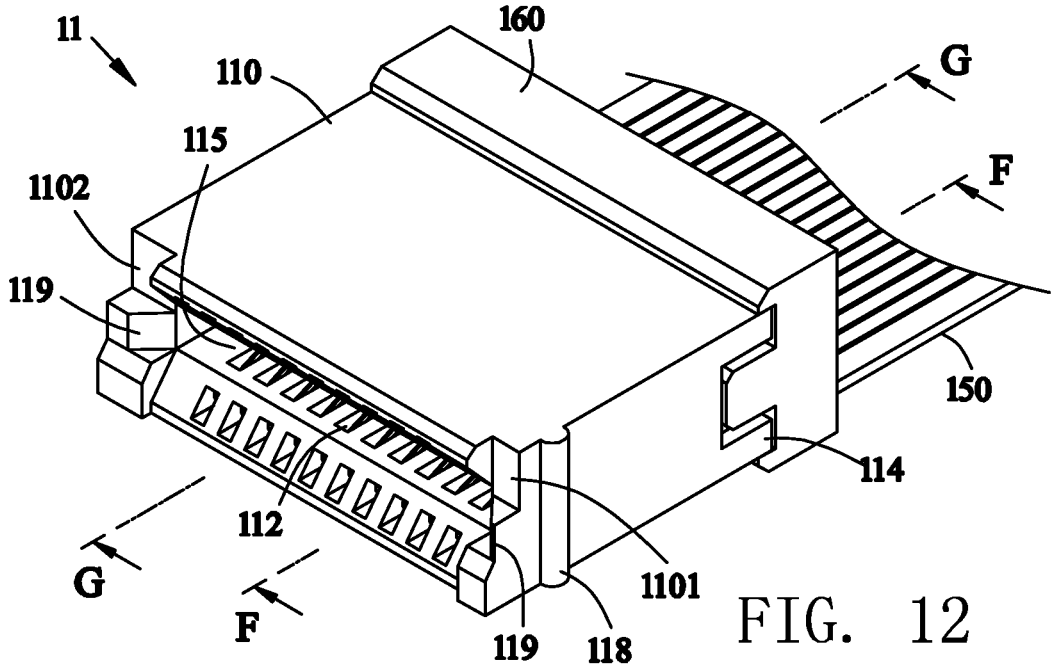
FIG. 12 is a diagram (1) showing a card edge connector assembly according to a second embodiment of the present invention.
Figure 13:
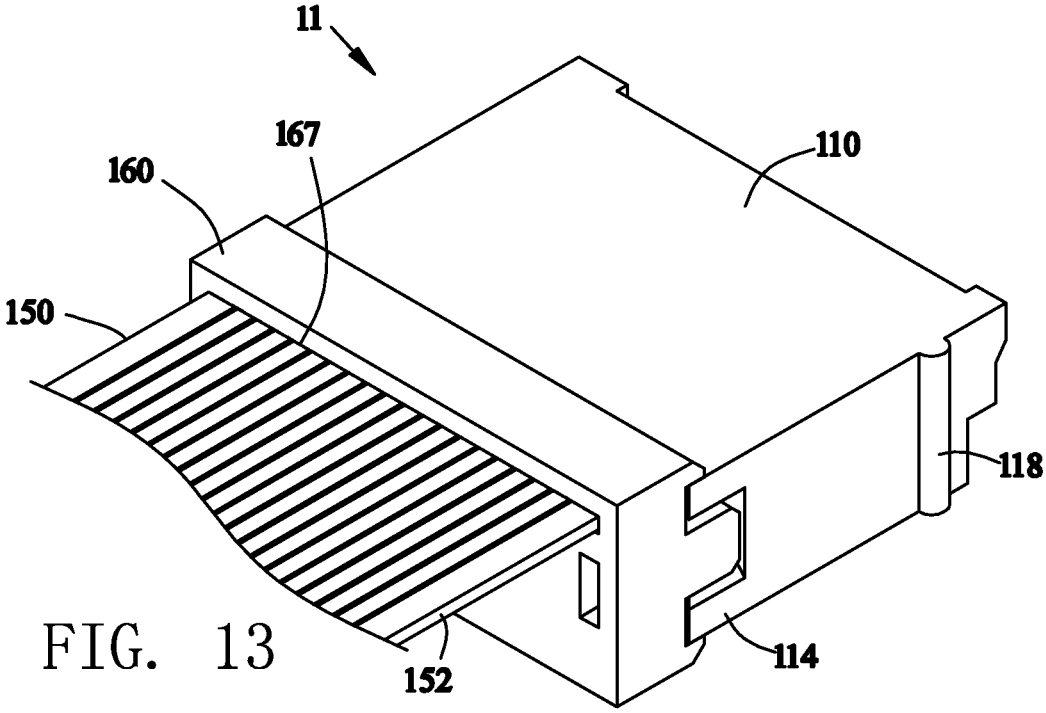
FIG. 13 is a diagram (2) showing a card edge connector assembly according to a second embodiment of the present invention.
Figure 14:
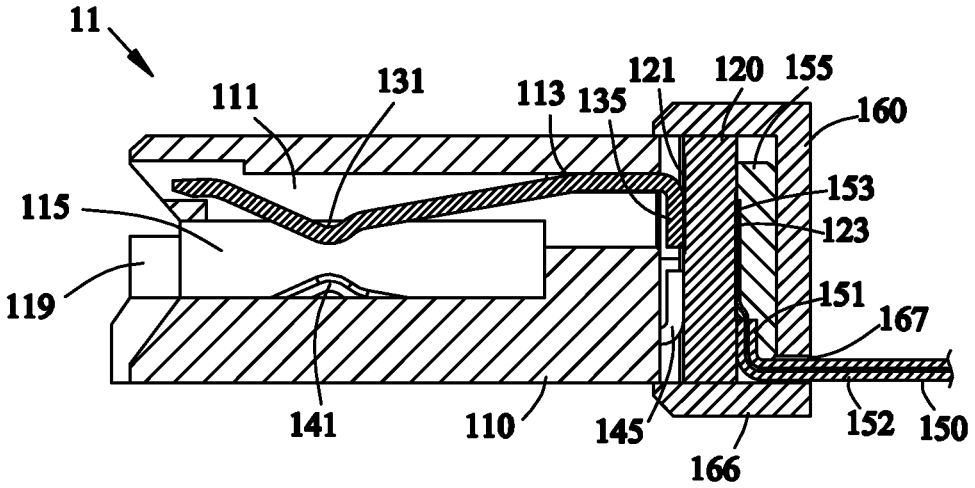
FIG. 14 is a cross view along F-F line shown in FIG. 12.
Figure 15:
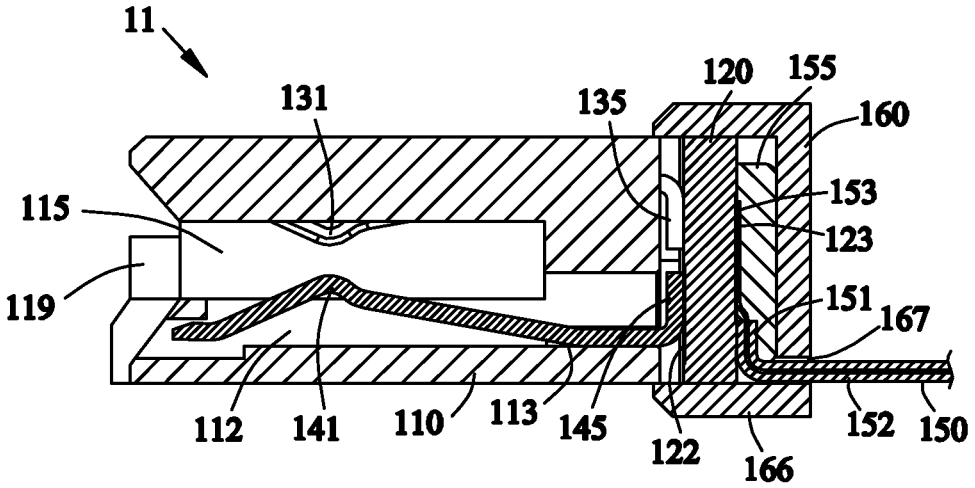
FIG. 15 is a cross view along G-G line shown in FIG. 12.
Figure 16:
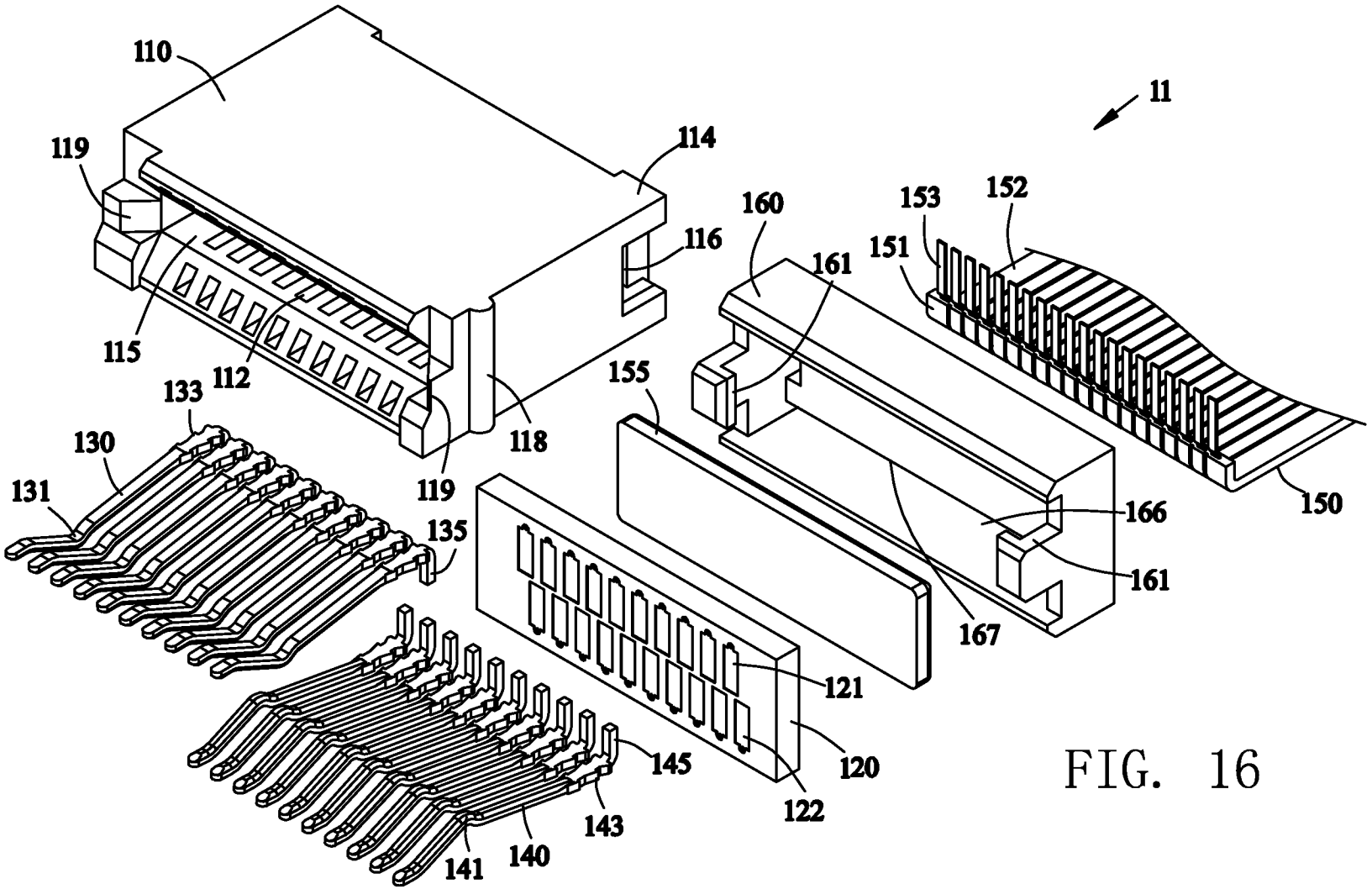
FIG. 16 is an explosion diagram (1) of a third embodiment.
Figure 17:
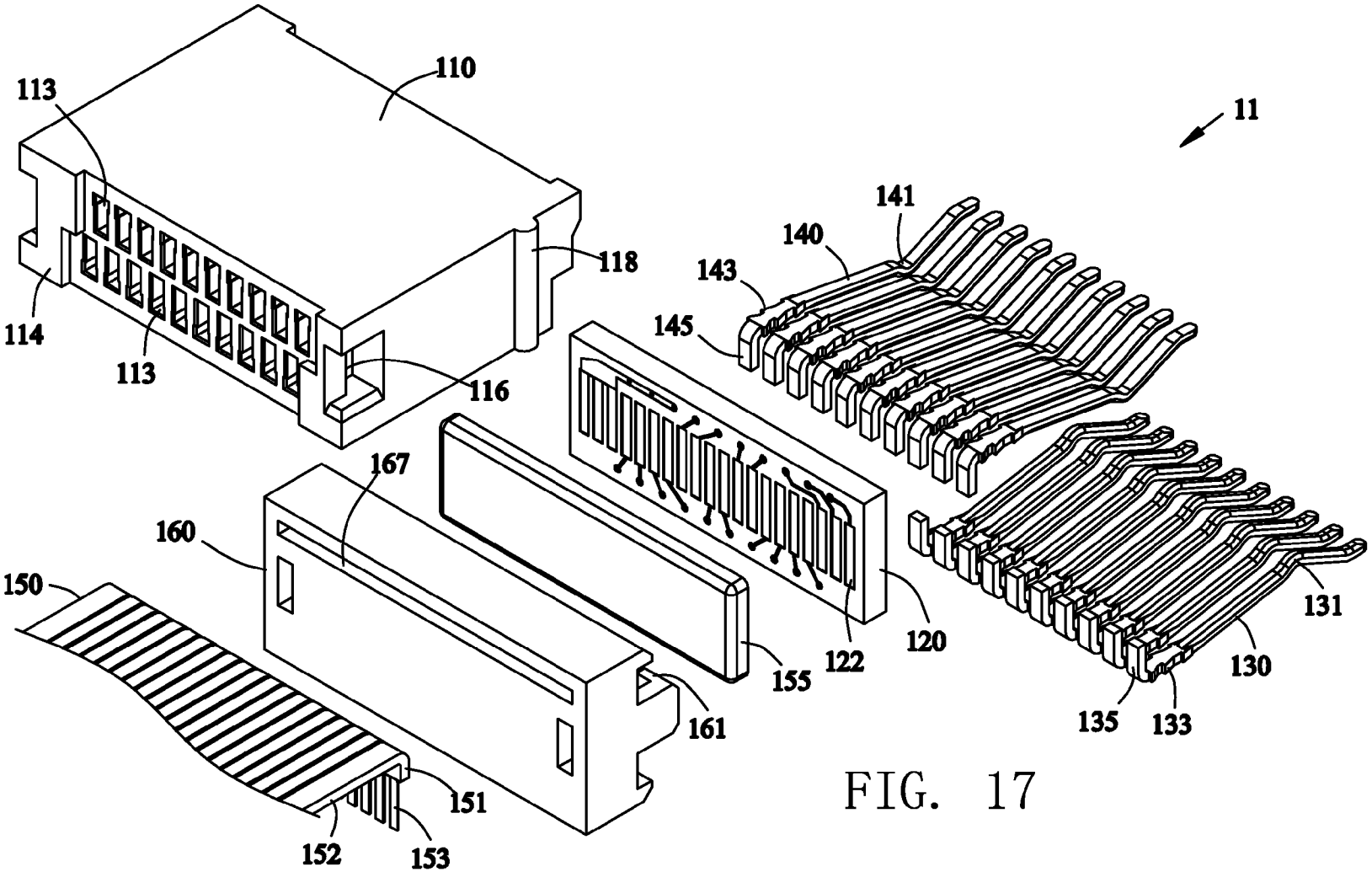
FIG. 17 is an explosion diagram (2) of a third embodiment.

The fool-proof mechanism of the insulating housing 110 and the second circuit board 170 is illustrated as follows: the first side 1101 and the second side 1102 of the insulating housing 110 have different thickness. The thickness T1 of the first side 1101 matches the groove 175 of the second circuit board 170, and the thickness T2 does not match the groove 175 of the second circuit board 170. Therefore, only the first side 1101 can be inserted into the groove 175 of the second circuit board 170. In this way, the fool-proof mechanism can be achieved as shown in FIG. 7-FIG. 9 in conjunction with FIG. 2.

Please refer to FIG. 12-FIG. 17. In a third embodiment, the card edge cable connector assembly 11 is mostly the same as the preferred embodiment. The difference between them is that the cover 160 has a limited mechanism to the first circuit board 120 and the line transmission device 150, and the limited mechanism is illustrated as follows: The cover 160 comprises a rectangular frame 166. The first circuit board 120 can be positioned inside the rectangular frame 166 and is limited by the rectangular frame 166. The cover 160 comprises a rectangular hole 167. The line transmission device 150 can stretch outside via the rectangular hole 167 of the cover 160.

Figure 18:
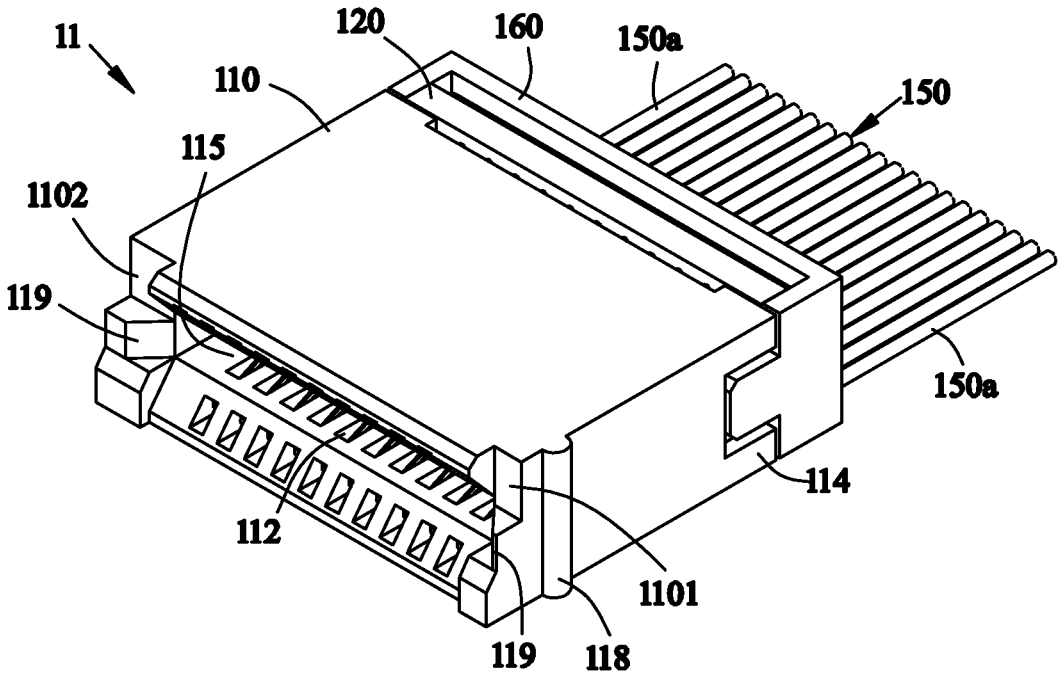
FIG. 18 is a diagram (1) showing a card edge connector assembly according to a fourth embodiment of the present invention.
Figure 19:
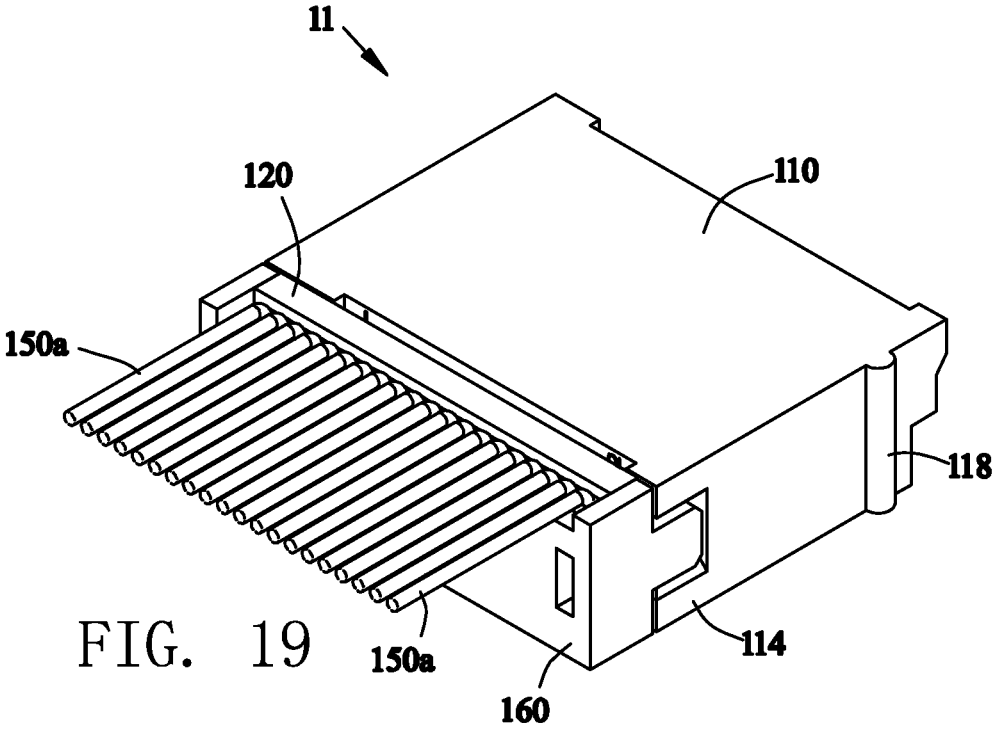
FIG. 19 is a diagram (2) showing a card edge connector assembly according to a fourth embodiment of the present invention.
Figure 20:
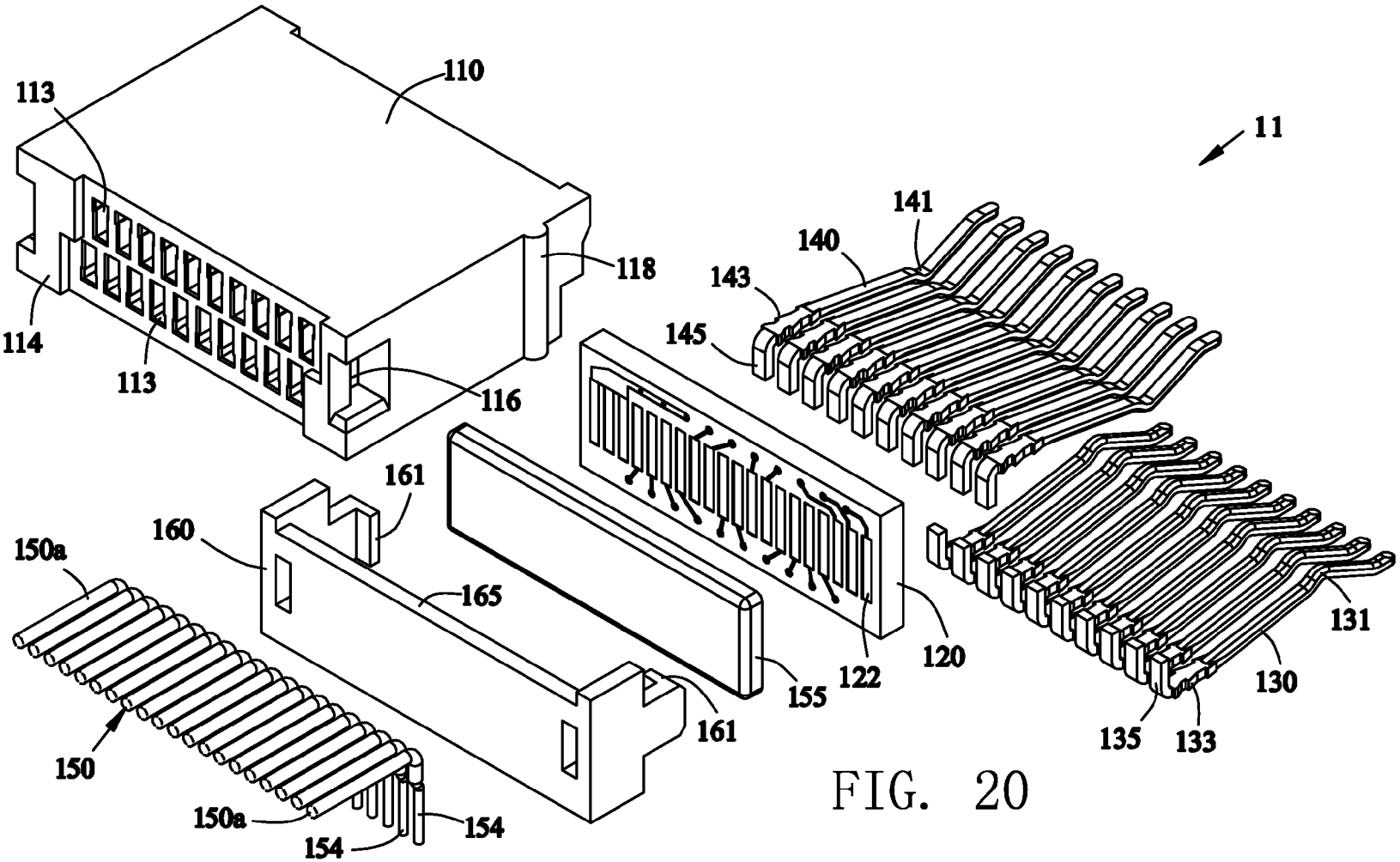
FIG. 20 is an explosion diagram of a fourth embodiment.
Figure 21:
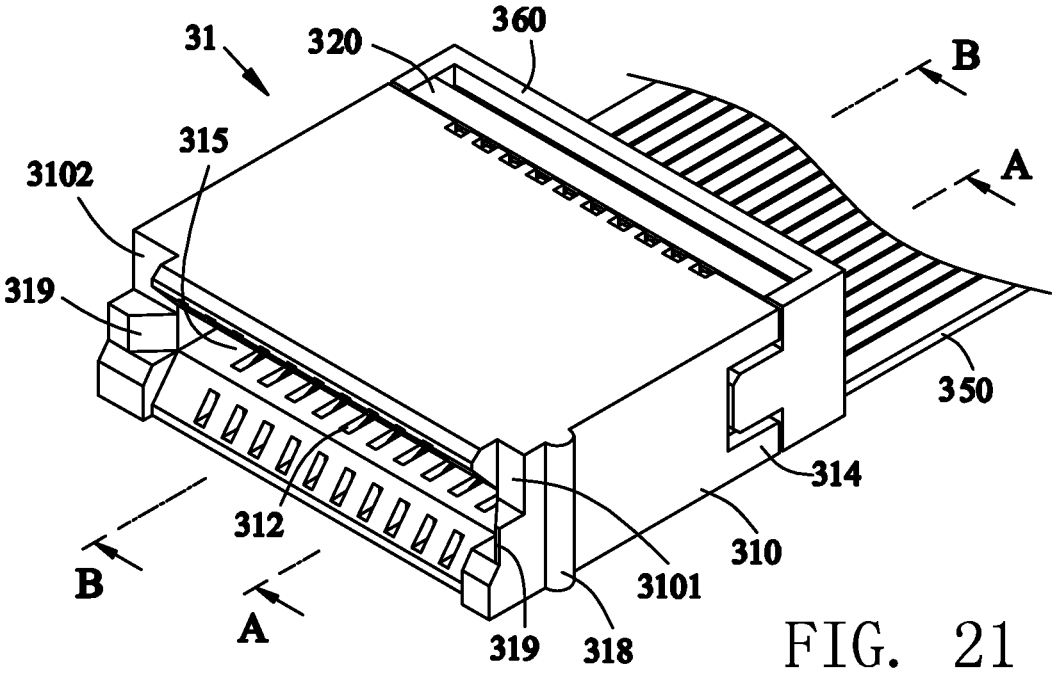
FIG. 21 is a diagram (1) showing a card edge connector assembly according to a fifth embodiment of the present invention.
Figure 22:
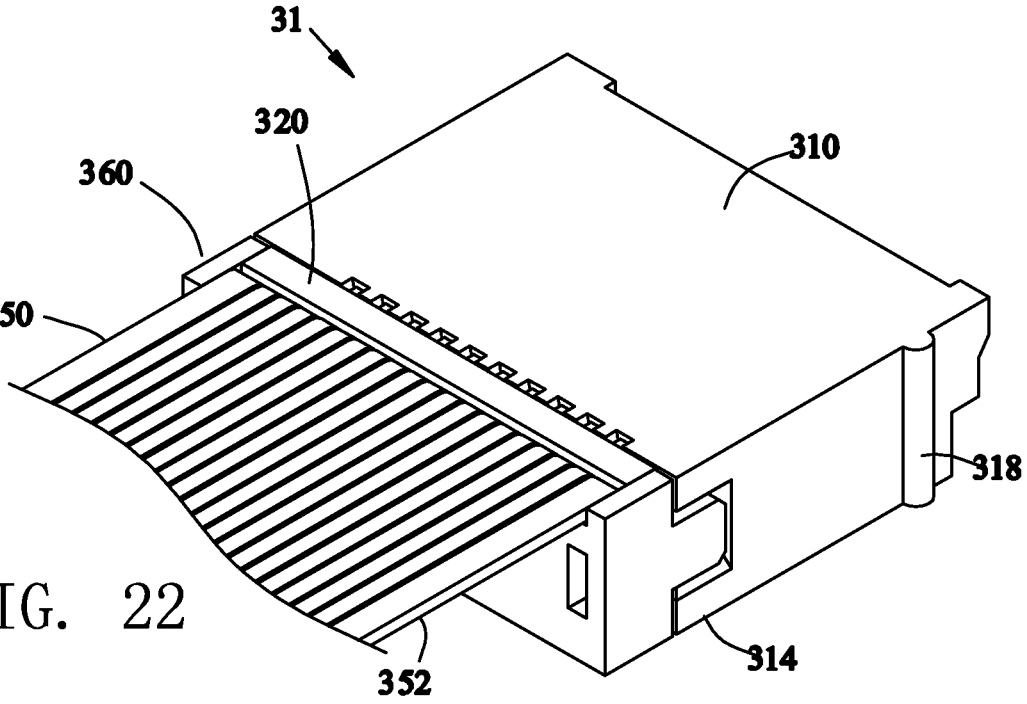
FIG. 22 is a diagram (2) showing a card edge connector assembly according to a fifth embodiment of the present invention.
Figure 23:
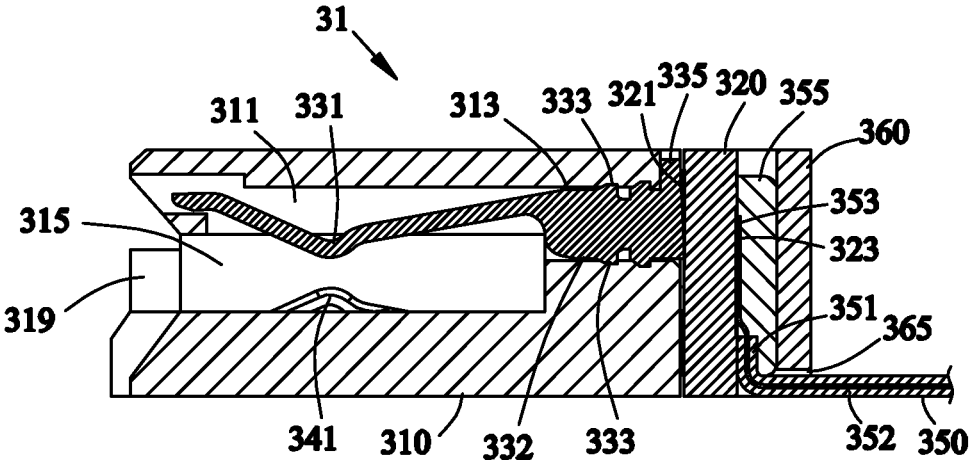
FIG. 23 is a cross view along A-A line shown in FIG. 21.
Figure 24:
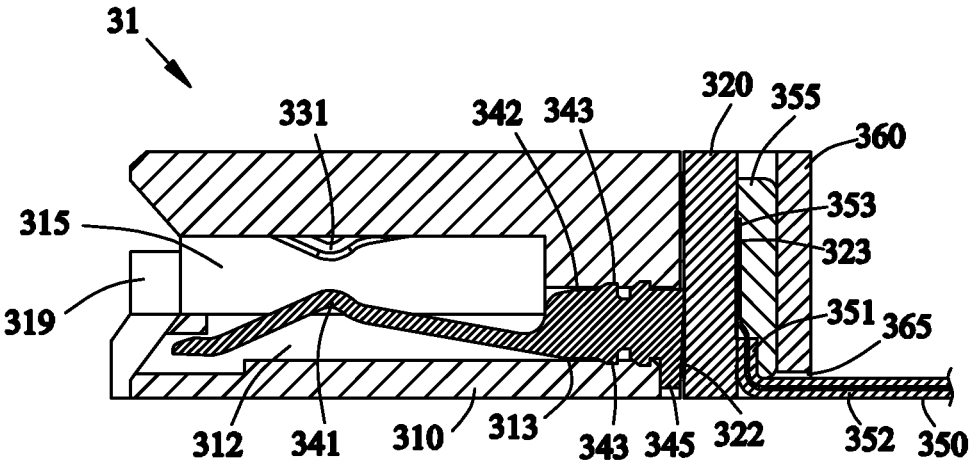
FIG. 24 is a cross view along B-B line shown in FIG. 21.

Please refer to FIG. 18-FIG. 20. In a fourth embodiment, the card edge cable connector assembly 11 is mostly the same as the preferred embodiment. The difference between them is that the line transmission device 150 comprises a plurality of wire cables 150*a*, and each of the wire cables 150*a* comprises a metal wire 154. The metal wires 154 of the wire cables 150*a* are electrically connected to contacts 123 of the first circuit board.

Please refer to FIG. 21-FIG. 28. In a fifth embodiment, the card edge cable connector assembly 31 comprises an insulating housing 310, a first circuit board 320, a plurality of first terminals 330, a plurality of second terminals 340, a line transmission device 350, and a cover 360. The insulating housing 310 comprises a plurality of first terminal holes 311, a plurality of second terminal holes 312, and a plurality of grooves 313. The first circuit board 320 comprises a plurality of first soldering portions 321, a plurality of second soldering portions 322, and a plurality of contacts 323. The vertical roots 332 of the first terminals 330 are fastened in the grooves 313 of the insulating housing 310 (ex: a pair of reversed spikes 333 fastened in the grooves 313). The ends 335 of the first terminals 330 are soldered to the first soldering portions 321 of the first circuit board 320. The vertical roots 342 of the second terminals 340 are fastened in the grooves 313 of the insulating housing 310 (ex: a pair of reversed spikes 343 fastened in the grooves 313). The ends 345 of the first terminals 330 are soldered to the second soldering portions 322 of the first circuit board 320. The line transmission device 350 can be a flex flat cable or a flexible printed circuit board. The line transmission device 350 comprises an insulating layer 352 and utilizes the insulting layer to cover a plurality of conductors 353. The conductors 353 are electrically connected to the contacts 323 of the first circuit board 320. The cover 360 is secured to the end 314 of the insulting housing 310. The insulating housing 310 comprises a plug space 315. The first terminal holes 311 are located on the top of the plug space 315, and the second terminal holes 312 are located on the bottom of the plug space 315. The mating portions 331 of the first terminals 330 stretch into the plug space 315 via the first terminal holes 311 and the mating portions 341 of the second terminals 340 stretch into the plug space 315 via the second terminal holes 312. Please note, the present invention add the second terminals 340 in addition to the first terminals 330, however, the mating portions 331 and the mating portions 341 are arranged as two rows respectively positioned on the top and the bottom. Therefore, the width of the insulating housing 310 can be optimally small. Furthermore, the first terminals 330 and the second terminals 340 are electrically connected to the line transmission device 350 via the first circuit board 320, and the height of the first circuit board 320 is less than or equal to the height of the insulating housing 310. Therefore, the height of the insulating housing 310 can be optimally small.

Figure 25:
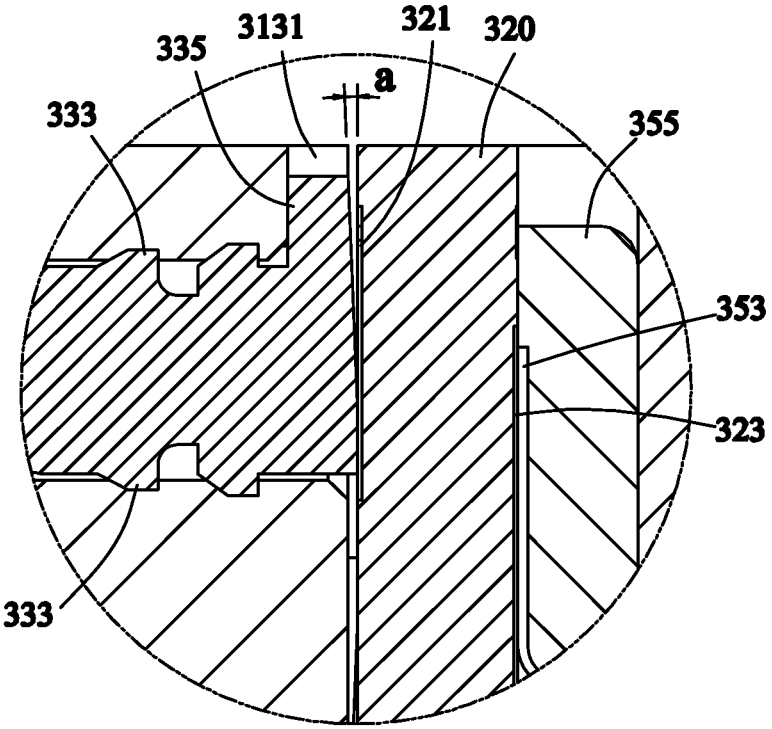
FIG. 25 is a partial scale-up diagram of FIG. 23.
Figure 26:
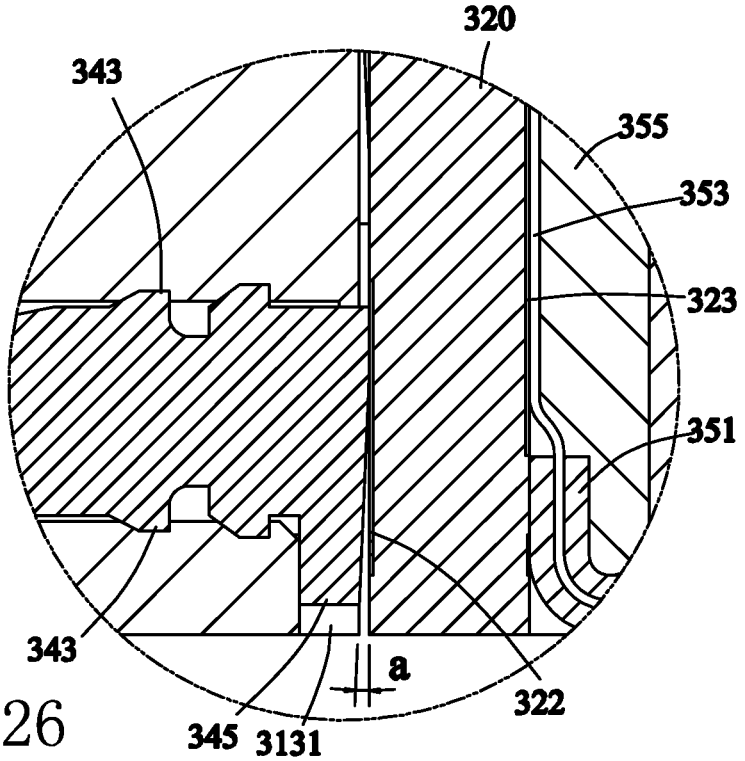
FIG. 26 is a partial scale-up diagram of FIG. 24.
Figure 27:
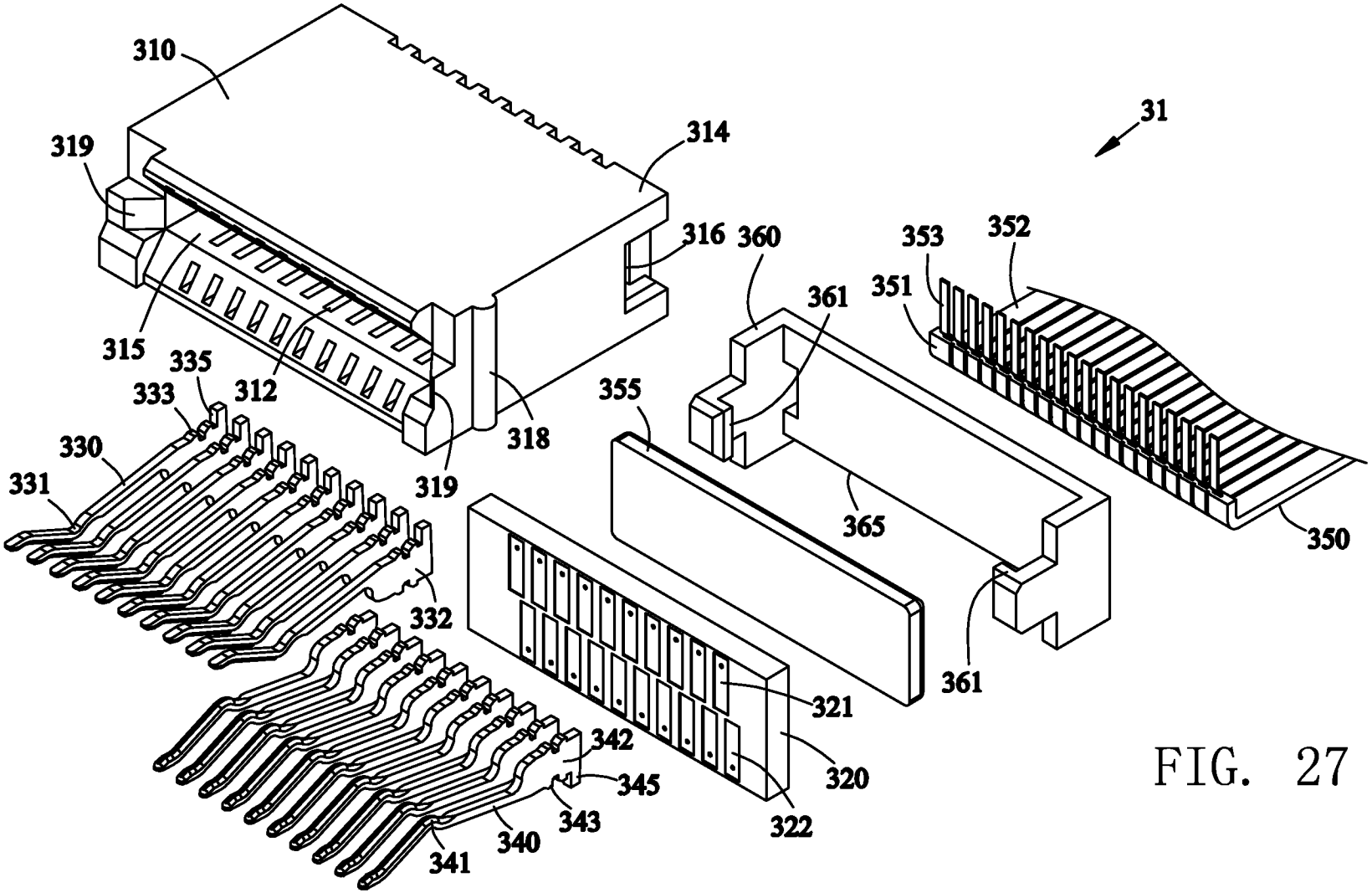
FIG. 27 is an explosion diagram (1) of a fifth embodiment.
Figure 28:
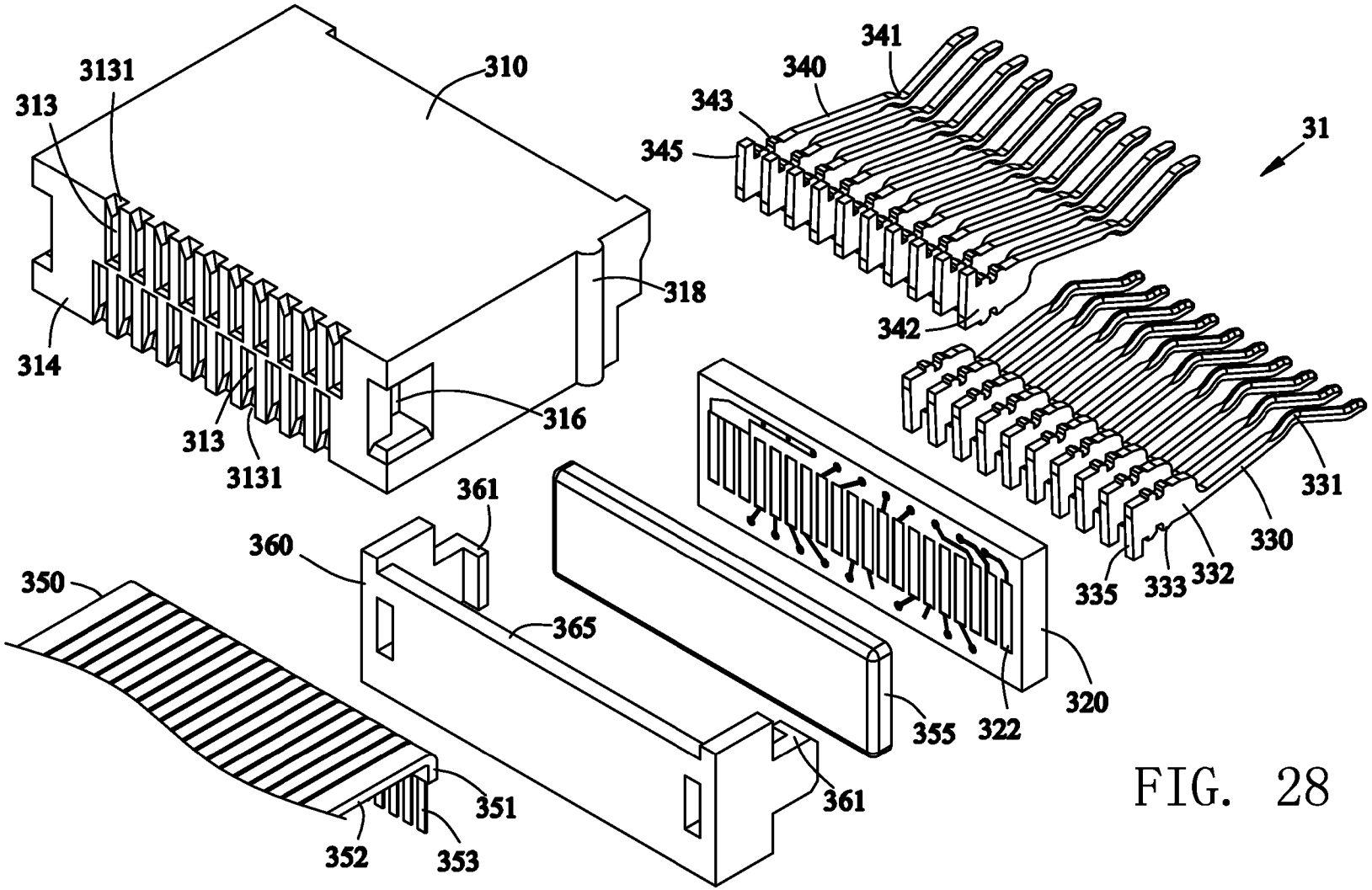
FIG. 28 is an explosion diagram (2) of a fifth embodiment.
Figure 29:
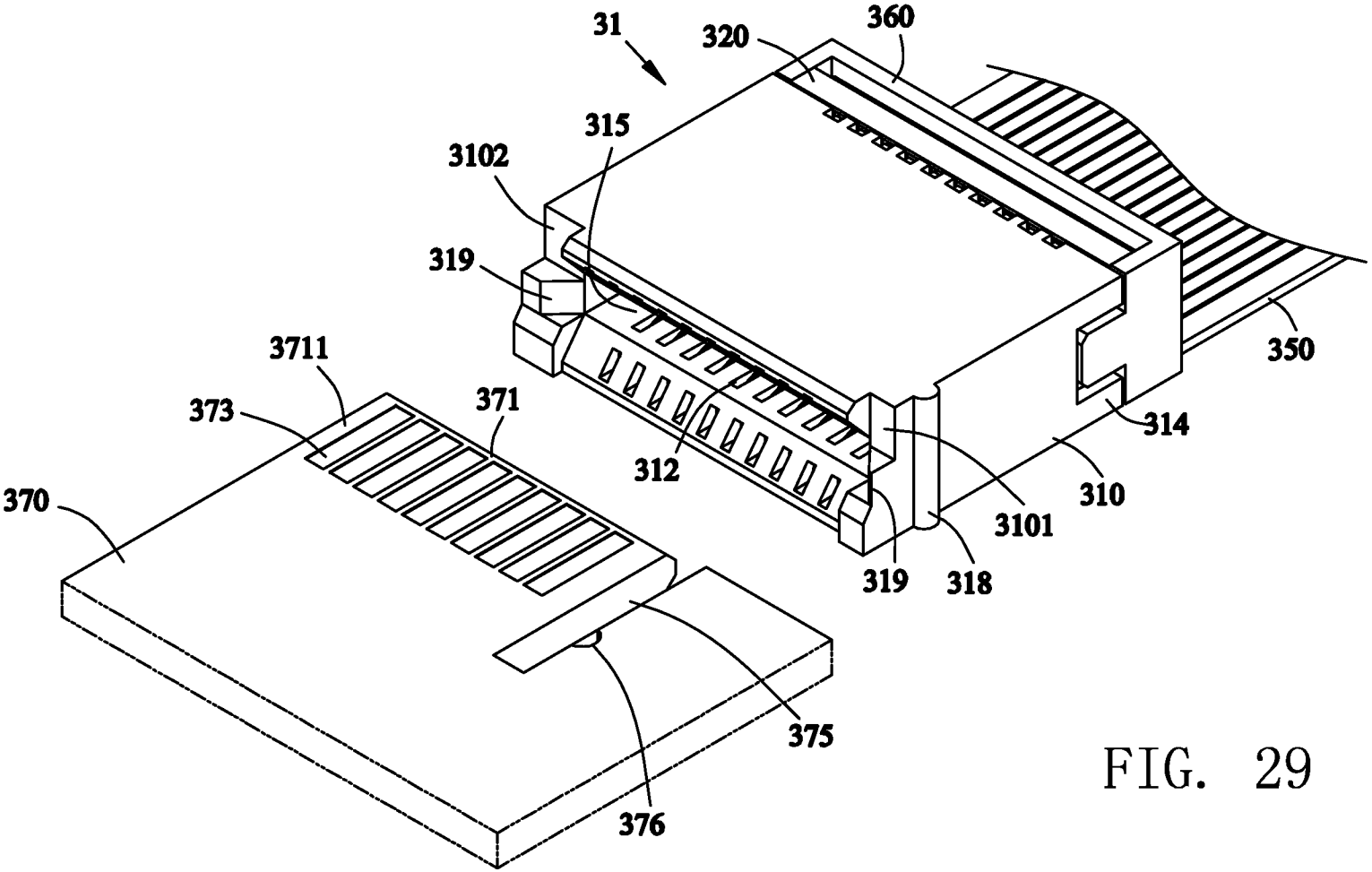
FIG. 29 is an explosion diagram (1) of a sixth embodiment.
Figure 30:
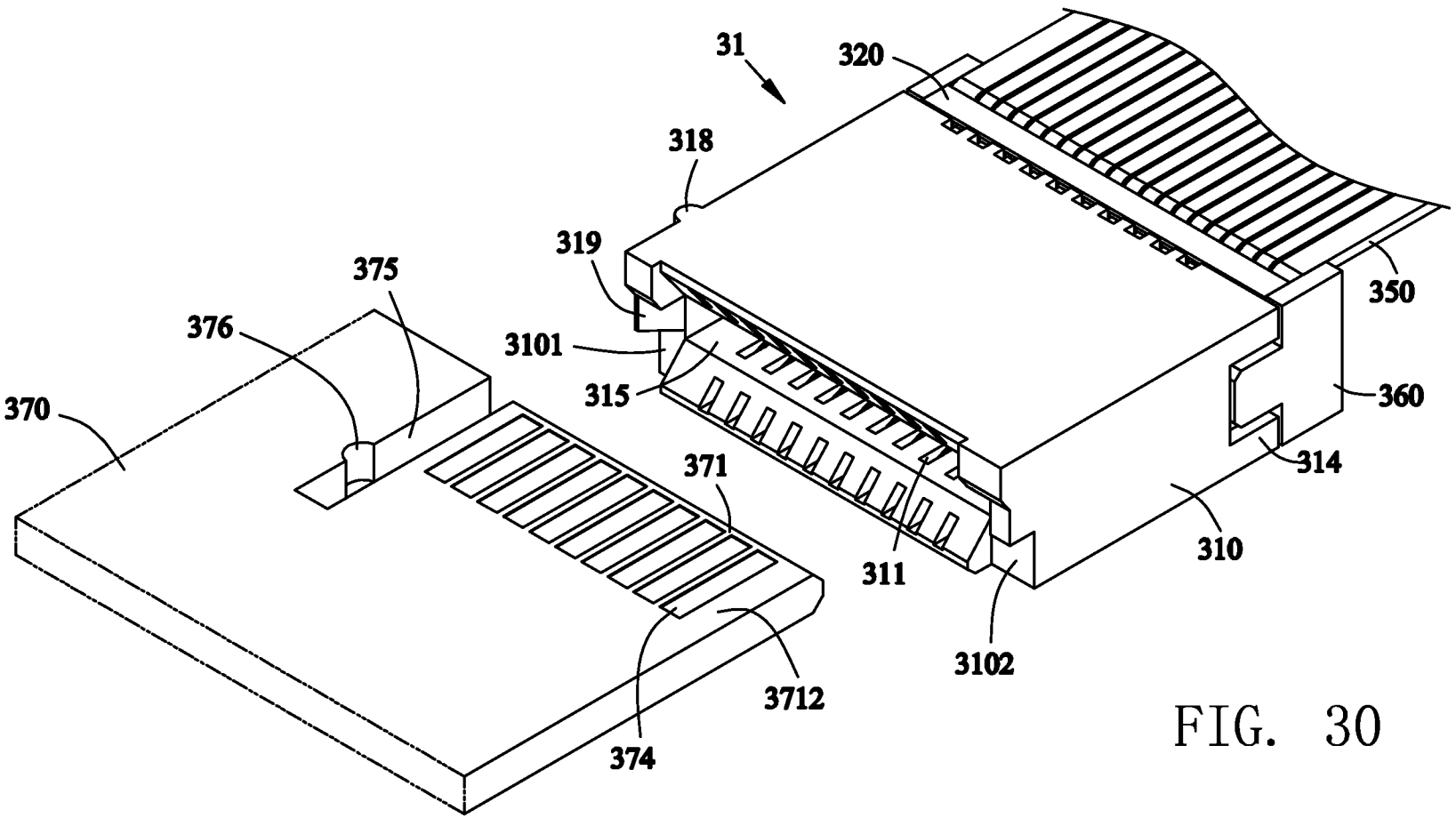
FIG. 30 is an explosion diagram (2) of the sixth embodiment.
Figure 31:
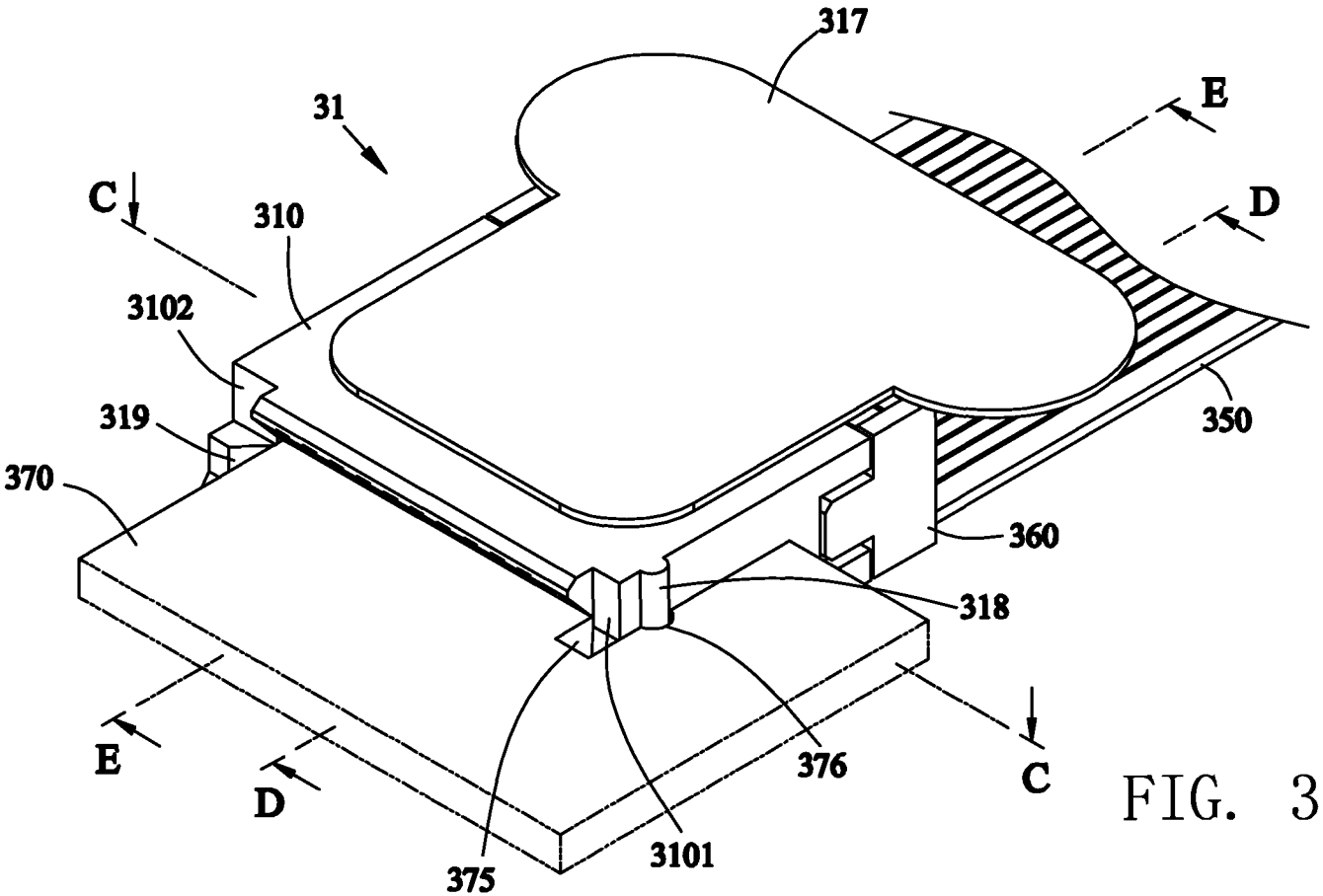
FIG. 31 is a diagram showing a card edge connector assembly according to a sixth embodiment of the present invention.

The arrangement of the first terminals 330 and the second terminals 340 are illustrated as follows: the first terminals 330 and the second terminals 340 are blanking terminals. The first terminals 130 and the second terminals 140 can be inserted via the end 314 of the insulating housing 310 and fastened inside the insulating housing 310. The grooves 313 of the insulating housing 310 comprise stretching grooves 3131. The ends 335 of the first terminals 330 and the ends 345 of the second terminals 340 are located in the stretching grooves 3131 to separate the ends 335 of the first terminals 330 and the ends 345 of the second terminals 340 (as shown in FIG. 27-FIG. 28 and FIG. 33-FIG. 34). The first terminals 330 are above the second terminals 340 and the mating portions 331 of the first terminals 330 and the mating portions 341 of the second terminals 340 are interlaced. The ends 335 of the first terminals 330 and the ends 345 of the second terminals 340 have a tilted angle a (as shown in FIG. 25-FIG. 26). When the ends 335 of the first terminals 330 and the ends 345 of the second terminals 340 are being soldered to the first soldering portions 321 and the second soldering portions 322 of the first circuit board 320, more solder (not shown) can enter the space formed by the tilted angle a.

The protection of the first circuit board 320 and the line transmission device 350 is illustrated as follows: a glue 355 is spread on the contacts 323 of the first circuit board 320 and the fronts 351 of the line transmission device 350, and the fronts 351 of the line transmission 350 has a bending angle. The cover 360 comprises a notch 365. The line transmission device 350 can stretch outside via the notch 365 of the cover 360 as shown in FIG. 23-FIG. 28.

Please refer to FIG. 29-FIG. 34. In a sixth embodiment, the card edge cable connector assembly 31 further comprises a second circuit board 370 (ex: a circuit board of a hard disk, a optical disk drive, or any other electronic devices). The first side 3101 of the insulating housing 310 further comprises a positioning block 318, and the front of the insulating housing 310 further comprises a pair of guiding blocks 319. The second circuit board 370 comprises a card edge portion 371. The front 3711 and the back 3712 of the card edge portion comprise a plurality of contacts 373 and 374. The card edge portion 370 can be inserted into the plug space 315 through the guiding mechanism of the guiding blocks 319. When the card edge portion 371 is inserted inside the plug space 315, the mating portions 331 of the first terminals 330 can be electrically connected to the contacts 374 of the back 3712 of the card edge portion 371. When the card edge cable connector assembly 31 or the second circuit board 370 are shocked, the line transmission device 350 can be used as a buffer. When the card edge cable connector assembly 31 or the second circuit board 370 are collided by an external force, the line transmission device 350 can be used as a buffer for preventing the second circuit board 370 from being damaged.

Figure 32:
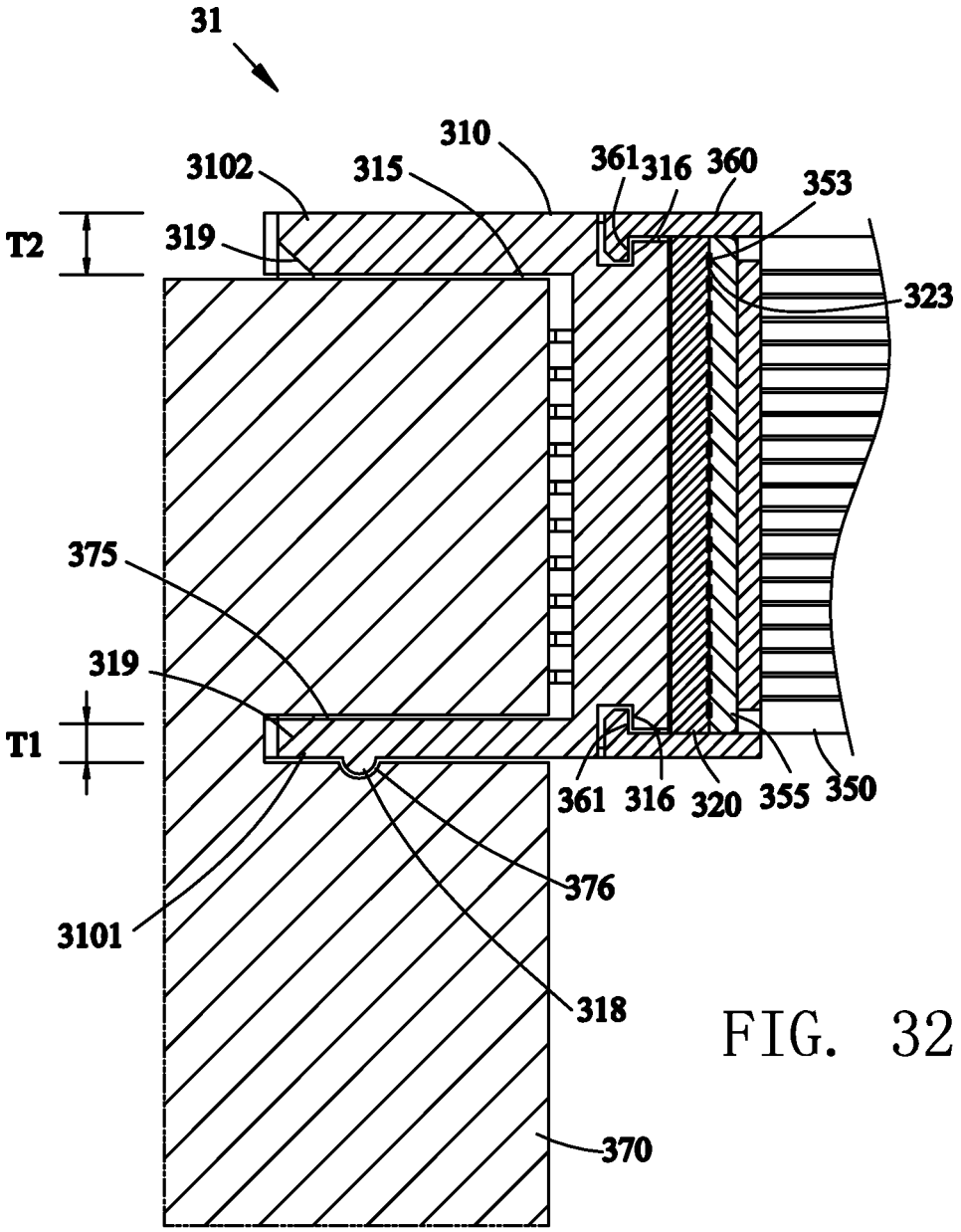
FIG. 32 is a cross view along C-C line shown in FIG. 31.
Figure 33:
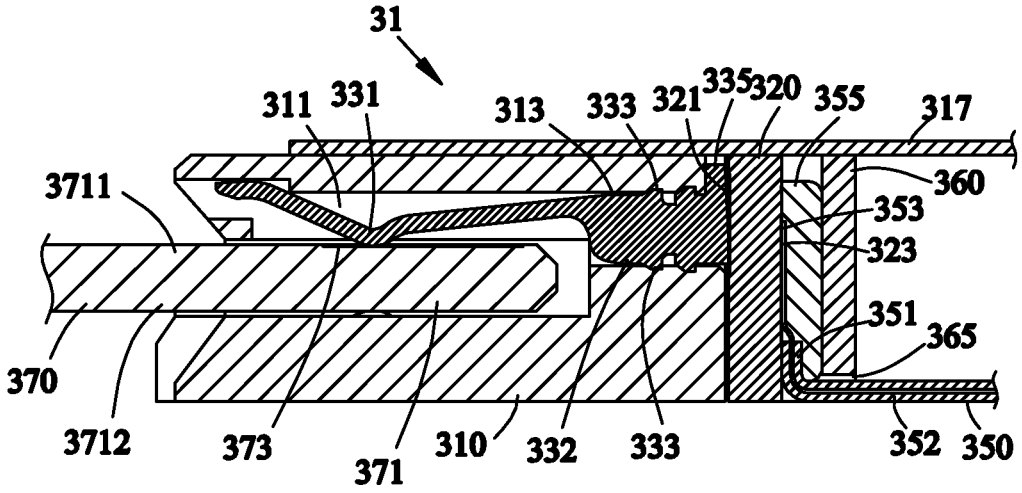
FIG. 33 is a cross view along D-D line shown in FIG. 31.
Figure 34:
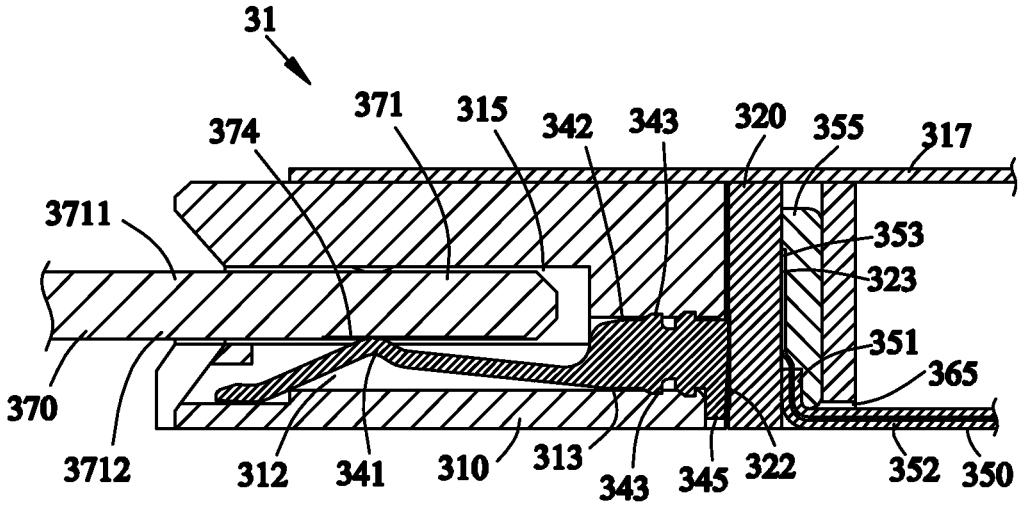
FIG. 34 is a cross view along E-E line shown in FIG. 31.
Figure 35:
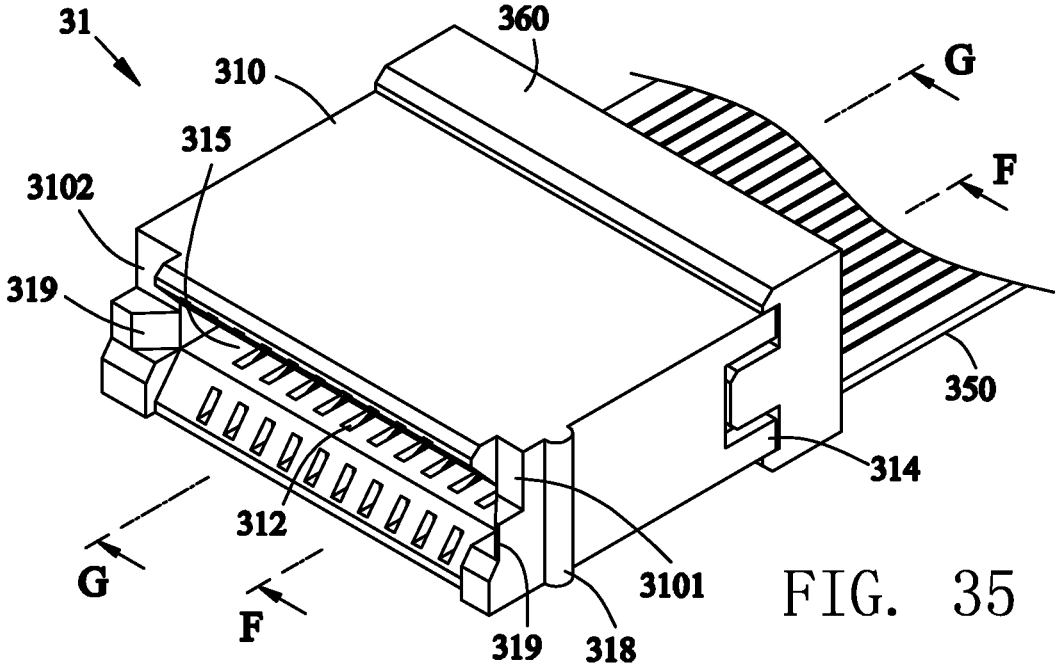
FIG. 35 is a diagram (1) showing a card edge connector assembly according to a seventh embodiment of the present invention.
Figure 36:
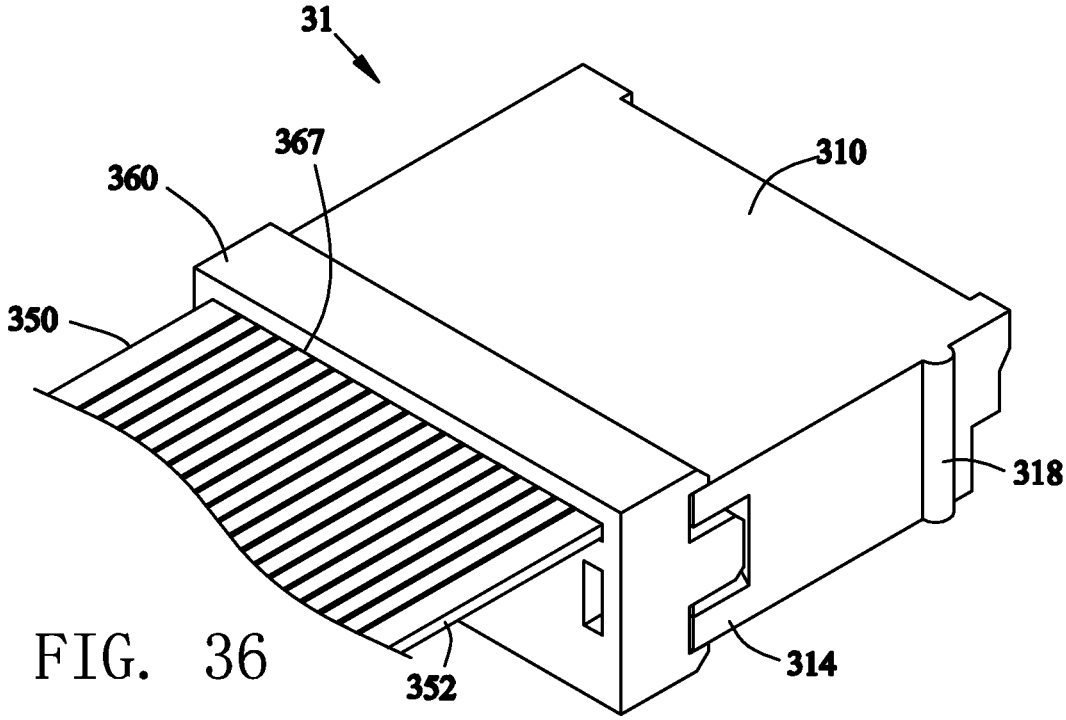
FIG. 36 is a diagram (2) showing a card edge connector assembly according to a seventh embodiment of the present invention.
Figure 37:
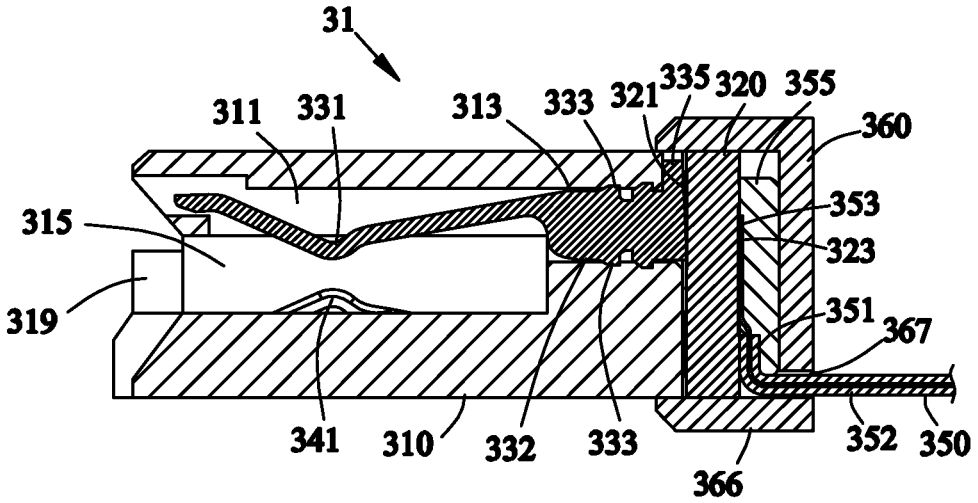
FIG. 37 is a cross view along F-F line shown in FIG. 35.
Figure 38:
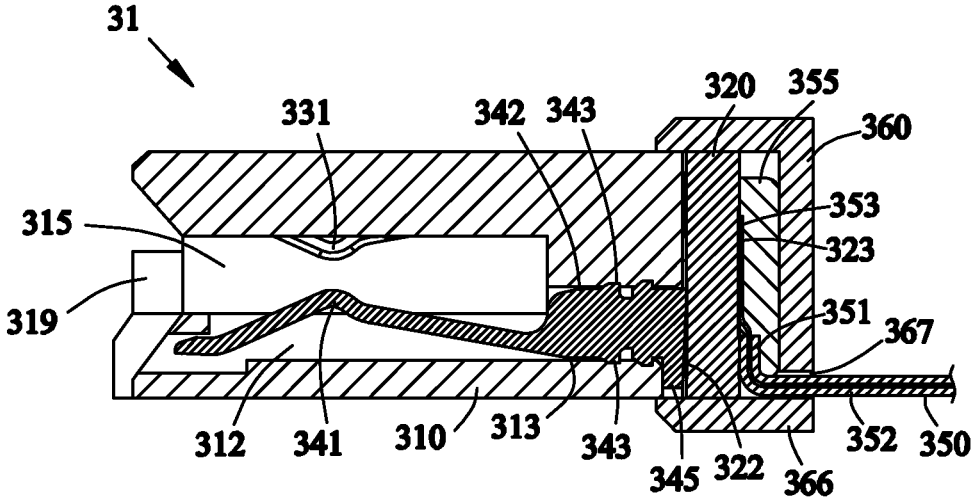
FIG. 38 is a cross view along G-G line shown in FIG. 35.
Figure 39:
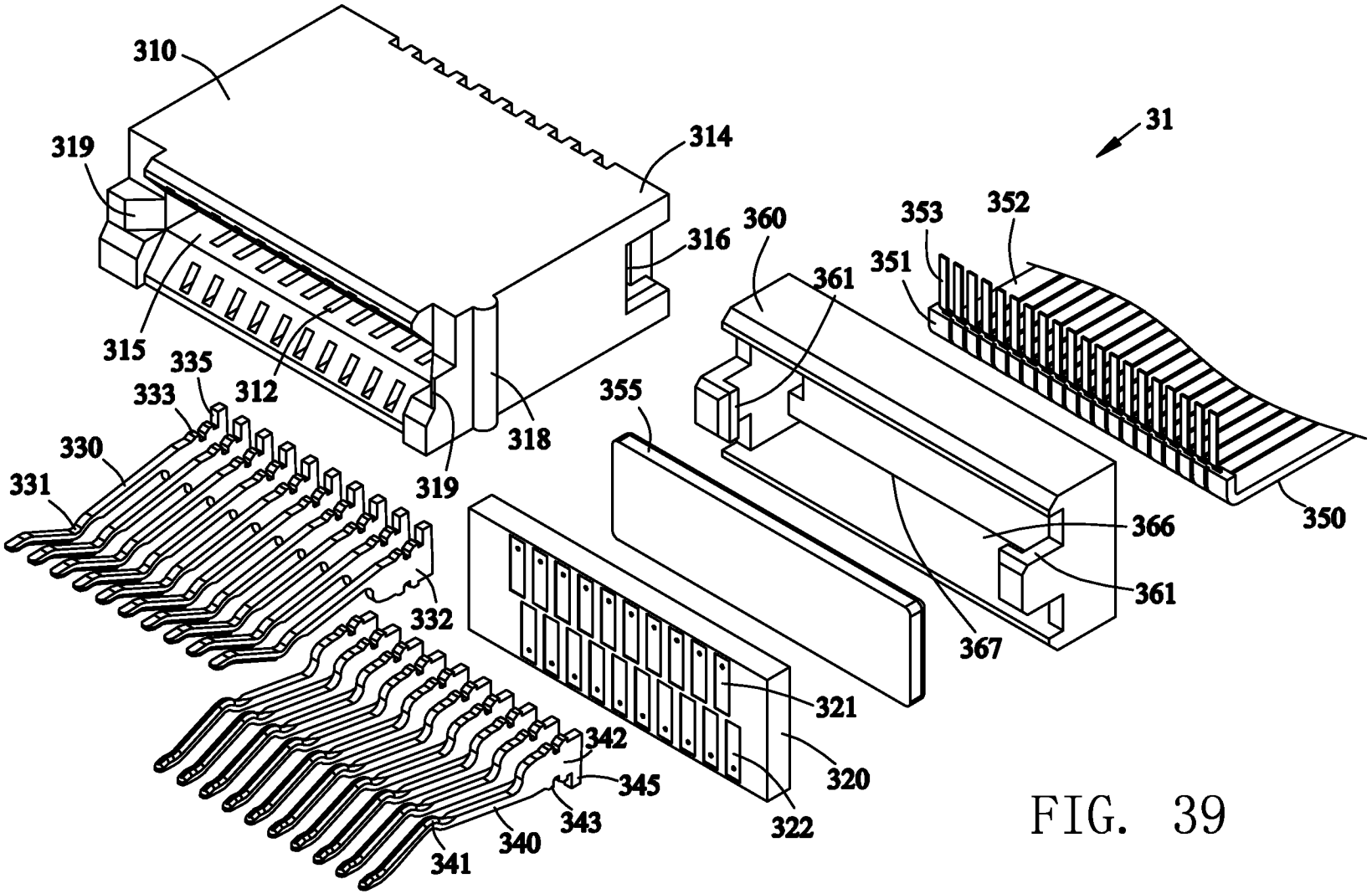
FIG. 39 is an explosion diagram (1) of a seventh embodiment.
Figure 40:
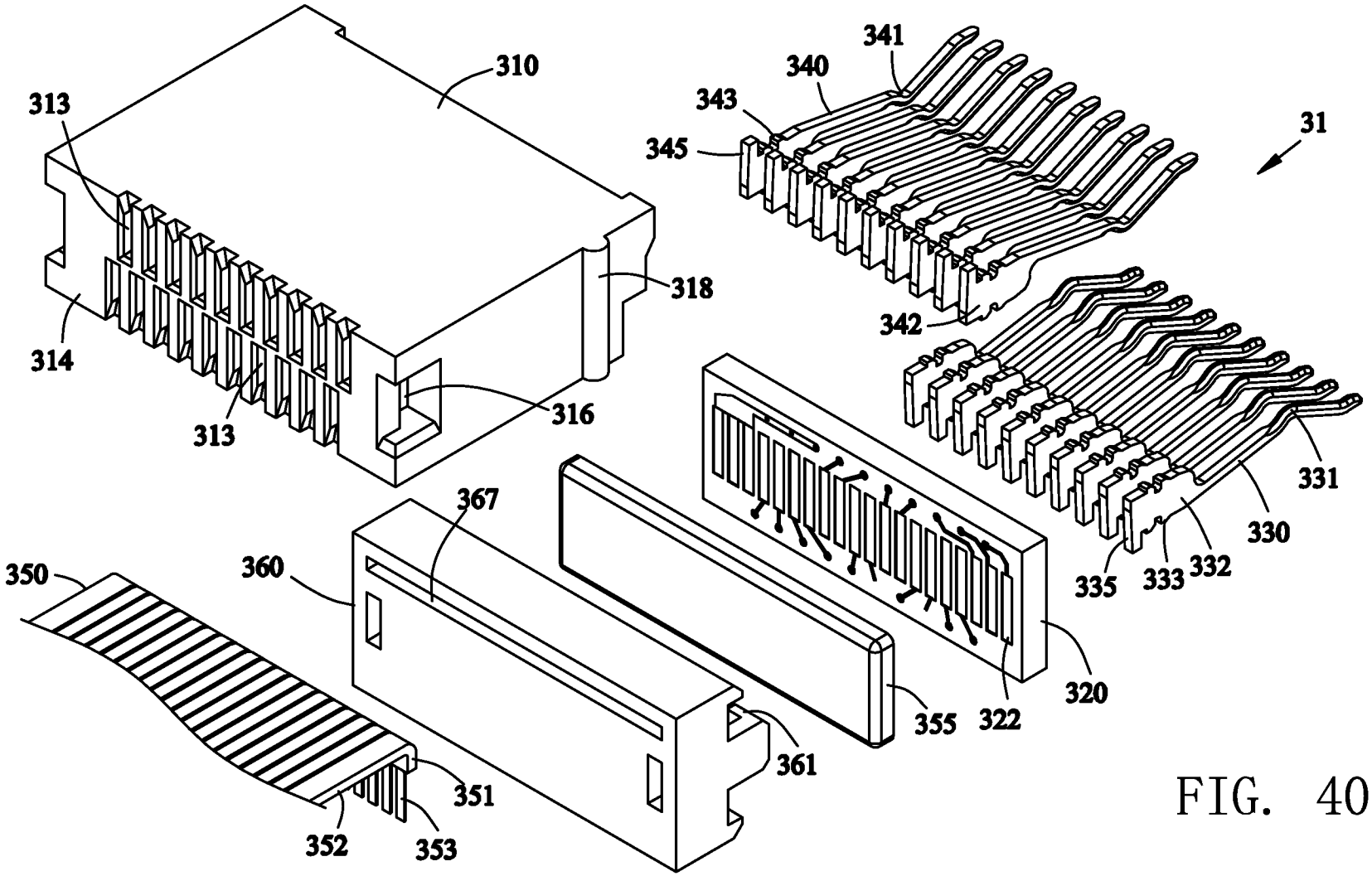
FIG. 40 is an explosion diagram (2) of a seventh embodiment.

The fixing mechanism of the cover 360 and the insulating housing 310 is illustrated as follows. The cover 360 utilizes a pair of piercers 360 to secure a pair of positioning portions 316 of the insulating housing 310 (as shown in FIG. 32).

The positioning mechanism of the insulating housing 310 and the second circuit board 370 is illustrated as follows: the second circuit board 370 can further comprise a groove 375 and a positioning portion. 376. The first side 3101 of the insulating housing 310 can be inserted into the groove 375 of the second circuit board 370 and the positioning block 318 of the insulating housing 310 can be secured to the positioning portion 376 of the second circuit board 370. In this way, the positioning mechanism of the insulating housing 319 and the second circuit board 370 is achieved as shown in FIG. 29-FIG. 32.

The fool-proof mechanism of the insulating housing 310 and the second circuit board 370 is illustrated as follows: the first side 3101 and the second side 3102 of the insulating housing 310 have different thickness. The thickness T1 of the first side 3101 matches the groove 375 of the second circuit board 370 and the thickness of the second side 3102 does not match the groove 375 of the second circuit board 370. Therefore, only the first side 3101 can be inserted into the groove 375 of the second circuit board 370. In this way, the fool-proof mechanism is achieved.

Please refer to FIG. 35-FIG. 40. In a seventh embodiment, the card edge cable connector assembly 31 is mostly the same as that of the fifth embodiment. The difference between them is that the cover 360 has a limited mechanism to the first circuit board 320 and the line transmission device 350, and the limited mechanism is illustrated as follows: The cover 360 comprises a rectangular frame 366. The first circuit board 320 can be positioned inside the rectangular frame 366 and is limited by the rectangular frame 366. The cover 360 comprises a rectangular hole 367. The line transmission device 350 can stretch outside via the rectangular hole 367 of the cover 360.

Figure 41:
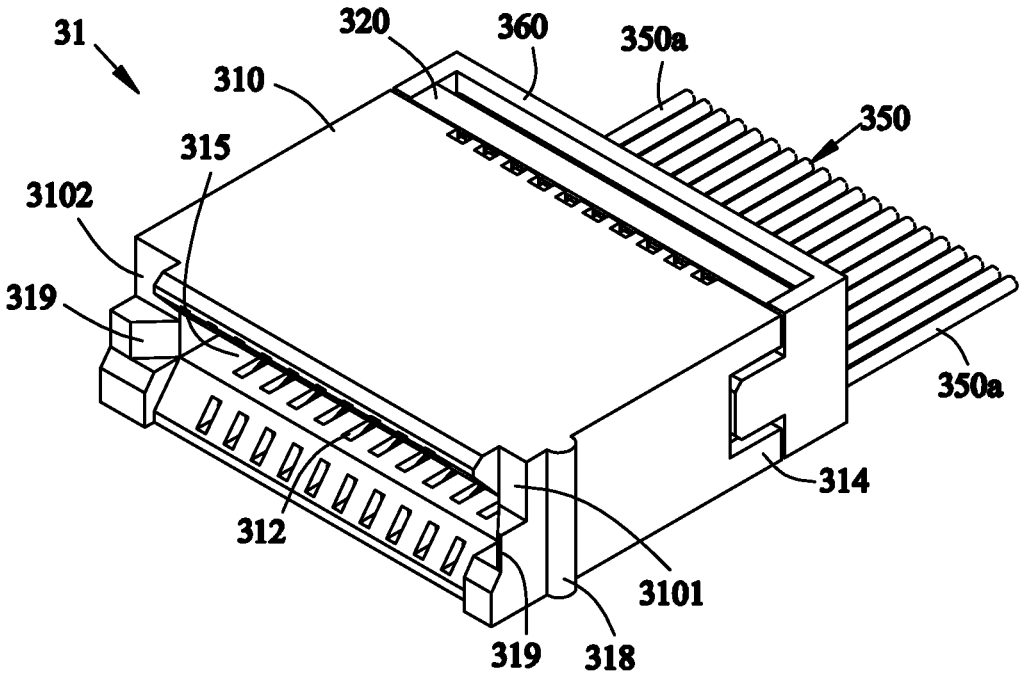
FIG. 41 is a diagram (1) showing a card edge connector assembly according to an eighth embodiment of the present invention.
Figure 42:
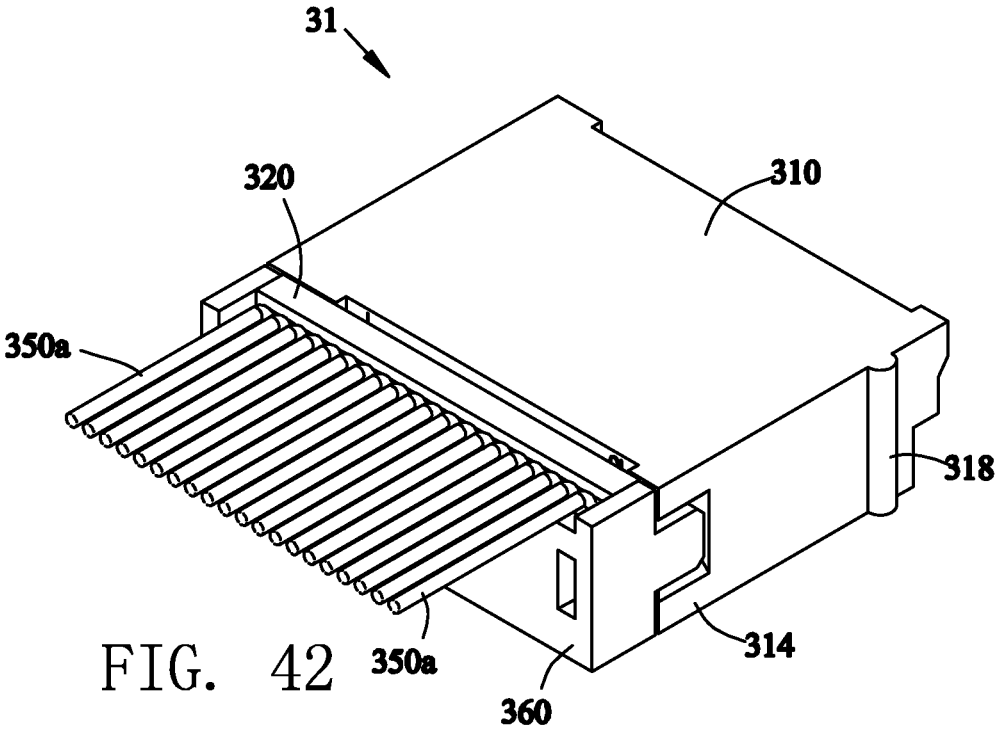
FIG. 42 is a diagram (2) showing a card edge connector assembly according to an eighth embodiment of the present invention.
Figure 43:
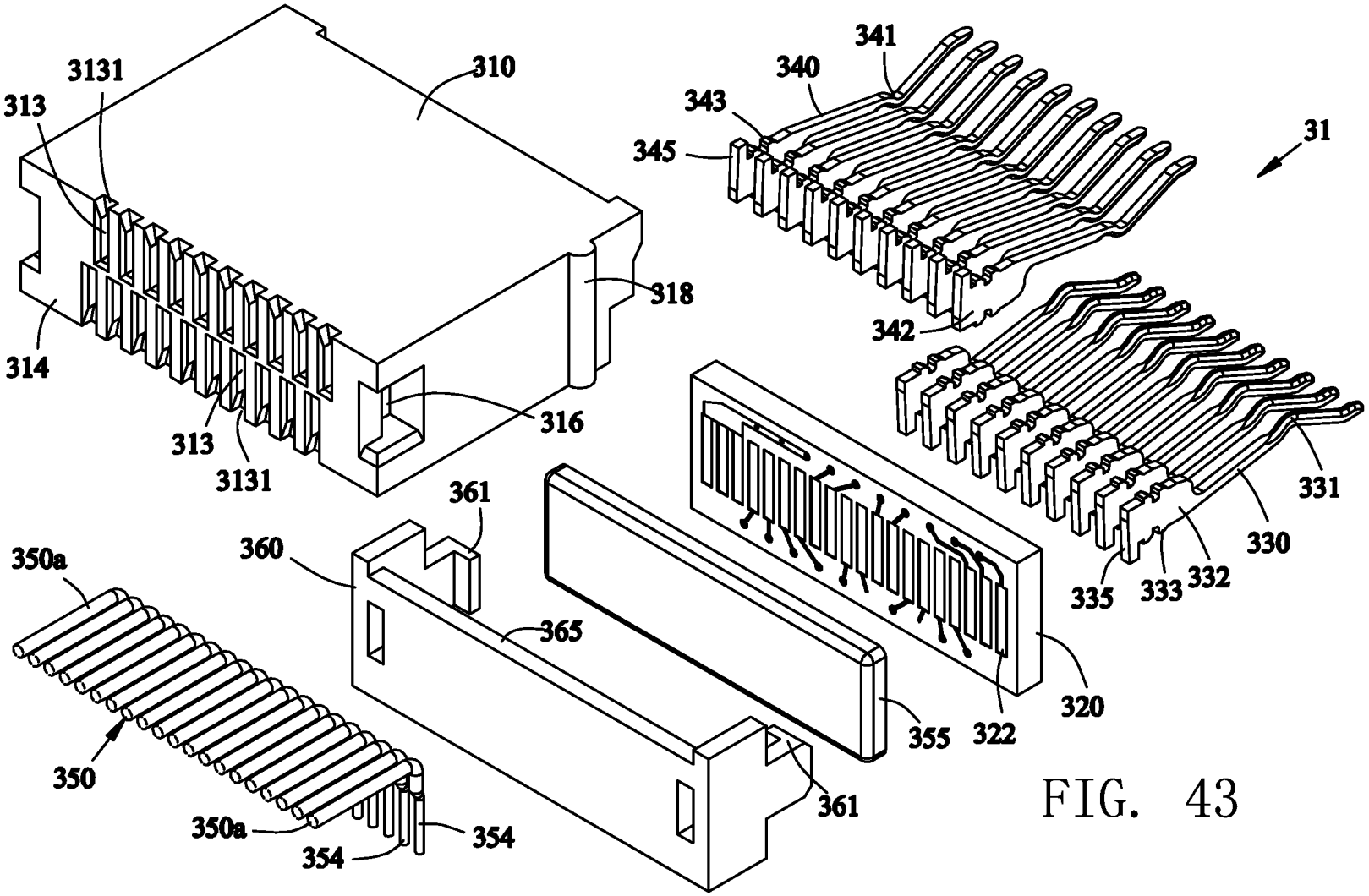
FIG. 43 is an explosion diagram of an eighth embodiment.

Please refer to FIG. 41-FIG. 43. In an eighth embodiment, the card edge cable connector assembly 31 is mostly the same as that of the fifth embodiment. The difference between them is that the line transmission device 350 comprises a plurality of wire cables 350*a*, and each of the wire cables 350*a* comprises a metal wire 354. The metal wires 354 of the wire cables 350*a* are electrically connected to contacts 323 of the first circuit board 320.

Figure 44:
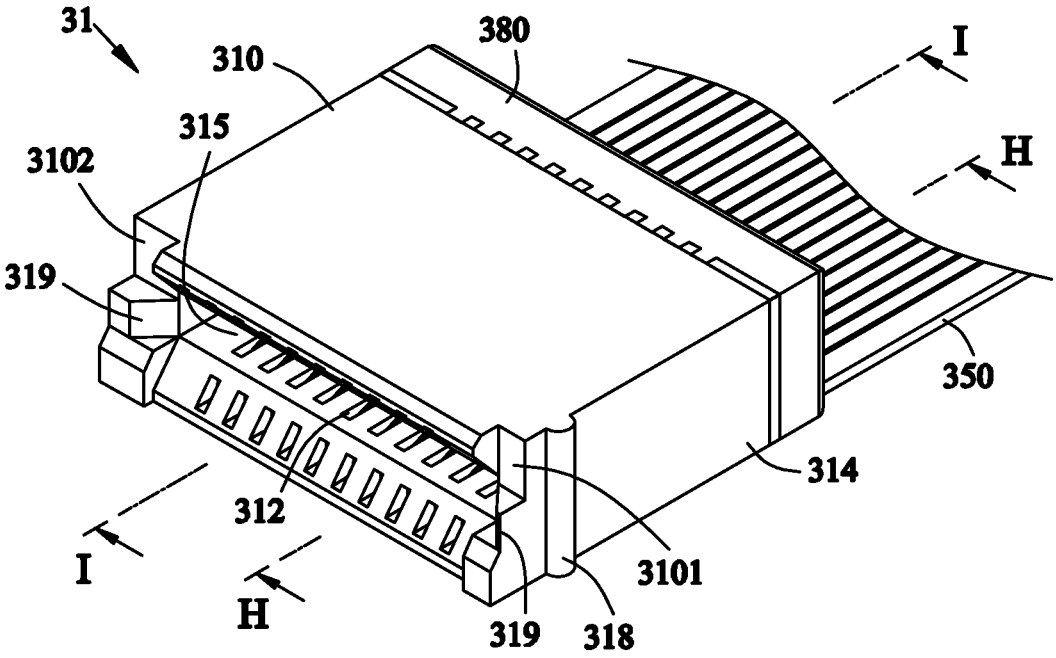
FIG. 44 is a diagram showing a card edge connector assembly according to a ninth embodiment of the present invention.
Figure 45:
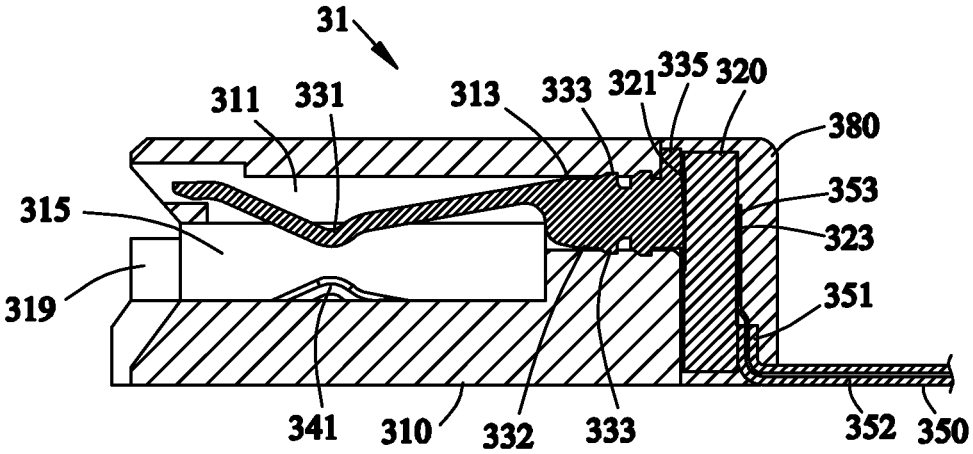
FIG. 45 is a cross view along H-H line shown in FIG. 44.
Figure 46:
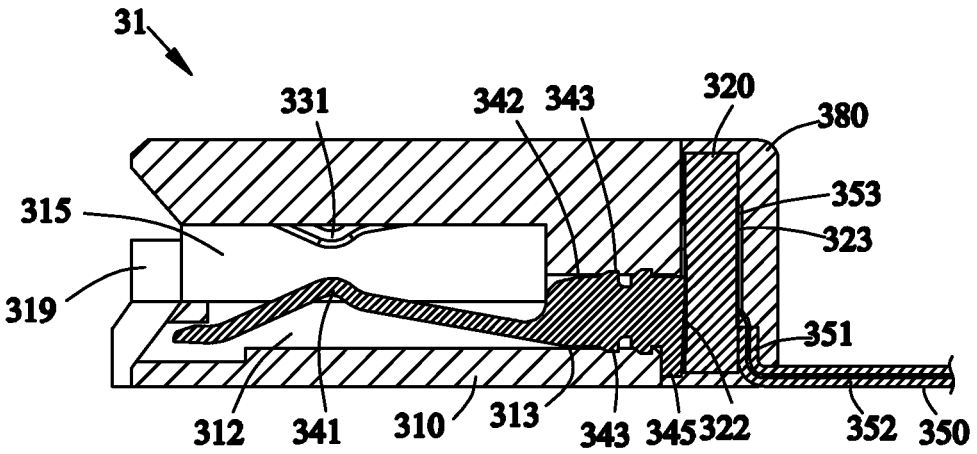
FIG. 46 is a cross view along I-I line shown in FIG. 44.

Please refer to FIG. 44-FIG. 46. In a ninth embodiment, the card edge cable connector assembly 31 is mostly the same as that of the fifth embodiment. The difference between them is that the card edge cable connector assembly 31 utilizes a covering body 380 to protect the metal wires 354 of the wire cables 350*a* and the contacts 323 of the first circuit board 320 and the covering body 380 is positioned on the end 314 of the insulating housing 310 and the front 351 of the line transmission device 350 in an over-molding way.

Figure 47:
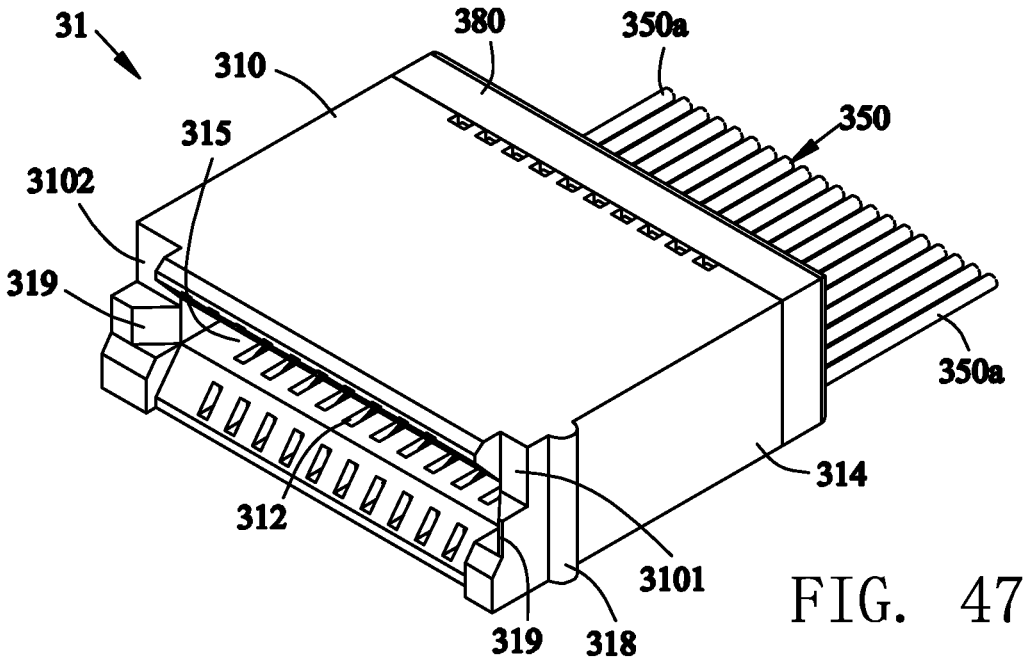
FIG. 47 is a diagram showing a card edge connector assembly according to a tenth embodiment of the present invention.
Figure 48:
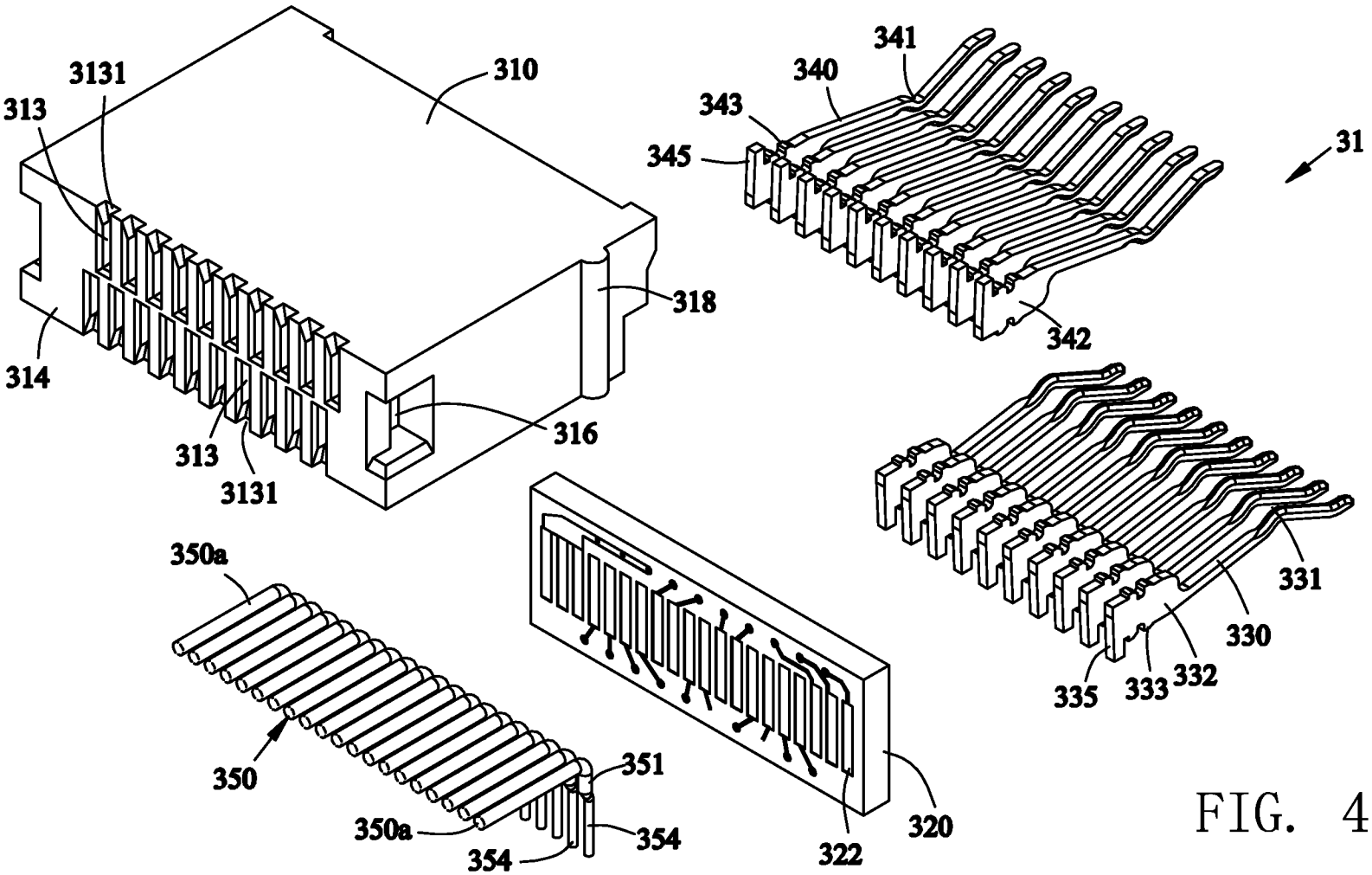
FIG. 48 is an explosion diagram of a tenth embodiment.

Please refer to FIG. 47-FIG. 48. In a tenth embodiment, the card edge cable connector assembly 31 is mostly the same as that of the eighth embodiment. The difference between them is that the card edge cable connector assembly 31 utilizes a covering body 380 to protect the metal wires 354 of the wire cables 350*a* and the contacts 323 of the first circuit board 320 and the covering body 380 is positioned on the end 314 of the insulating housing 310 and the front 351 of the line transmission device 350 in an over-molding way.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A card edge cable connector assembly comprising:

an insulating housing, comprising a plurality of first terminal holes, a plurality of second terminal holes, and a plurality of grooves;

a first circuit board, comprising a plurality of first soldering portions, a plurality of second soldering portions, and a plurality of contacts;

a plurality of first terminals, fastened in the grooves of the insulating housing, and ends of the first terminals are soldered together with the first soldering portions of the first circuit board;

a plurality of second terminals, fastened in the grooves of the first insulating housing, and ends of the second terminals are soldered together with the second soldering portions of the first circuit board;

a line transmission device, comprising a plurality of conductors electrically connected to the contacts of the first circuit board; and a cover, secured to an end of the insulating housing;

wherein the insulating housing further comprises a plug space, the first terminal holes are located on a top of the plug space, the second terminal holes are located on a bottom of the plug space, mating portions of the first terminals stretch into the plug space via the first terminal holes, and mating portions of the second terminals stretch into the plug space via the second terminal holes.

2. The card edge cable connector assembly of claim 1, wherein the first terminals are above the second terminals, and the mating portions of the first terminals and the mating portions of the second terminals are interlaced.

3. The card edge cable connector assembly of claim 1, wherein glue is spread on the contacts of the first circuit board and a front of the line transmission device, and the front of the line transmission device has a bending angle.

4. The card edge cable connector assembly of claim 1, wherein the cover comprises a pair of piercers for securing a pair of roots, and the cover further comprises a notch, wherein the line transmission device is capable of stretching outside via the notch.

5. The card edge cable connector assembly of claim 1, wherein the cover comprises a rectangular frame, the first circuit board is limited inside the rectangular frame, and the cover further comprises a rectangular hole, and the line transmission device is capable of stretching outside via the rectangular hole.

6. The card edge cable connector assembly of claim 1, further comprising: a pulling band positioned on the insulating housing or the cover, wherein the insulating housing comprises a positioning block on a first side, and a pair of guiding blocks on a front end.

7. The card edge cable connector assembly of claim 1, further comprising:

a second circuit board, comprising a card edge portion, comprising a plurality of contacts on a front and a back of the card edge portions;

wherein the card edge portion is capable of being plugged into the plug space of the insulating housing and the mating portions of the first terminals are capable of electrically connected to the contacts on the front of the card edge portion, the mating portions of the second terminals are capable of being electrically connected to the contacts on the back of the card edge portion.

8. The card edge cable connector assembly of claim 7, wherein a thickness of a first side of the insulating housing is less than a thickness of a second side of the insulating housing.

9. The card edge cable connector assembly of claim 7, wherein the second circuit board comprises a groove and a positioning portion, and a first side of the insulating housing is capable of being inserted into the groove of the second circuit board, and the positioning block is capable of being secured to the positioning portion of the second circuit board.

10. The card edge cable connector assembly of claim 1, wherein the line transmission device is a flex flat cable, a flexible printed circuit board, or a wire cable.

11. A card edge cable connector assembly comprising:

an insulating housing, comprising a plurality of first terminal holes, a plurality of second terminal holes, and a plurality of grooves;

a first circuit board, comprising a plurality of first soldering portions, a plurality of second soldering portions, and a plurality of contacts;

a plurality of first terminals, comprising a plurality of vertical roots fastened in the grooves of the insulating housing, and ends of the first terminals are soldered together with the first soldering portions of the first circuit board;

a plurality of second terminals, comprising a plurality of vertical roots fastened in the grooves of the first insulating housing, and ends of the second terminals are soldered together with the second soldering portions of the first circuit board;

a line transmission device, comprising a plurality of conductors electrically connected to the contacts of the first circuit board; and a cover, secured to an end of the insulating housing;

wherein the insulating housing further comprises a plug space, the first terminal holes are located on a top of the plug space, the second terminal holes are located on a bottom of the plug space, mating portions of the first terminals stretch into the plug space via the first terminal holes, and mating portions of the second terminals stretch into the plug space via the second terminal holes.

12. The card edge cable connector assembly of claim 11, wherein the first terminals and the second terminals are blanking terminals, the vertical roots of the first terminal and the second terminals are fastened in the grooves of the insulating housing by utilizing a pair of reversed spikes, the grooves comprises stretched grooves, and the ends of the first terminals and the second terminals are located in the stretched grooves.

13. The card edge cable connector assembly of claim 11, wherein the line transmission device is a flex flat cable or a flexible printed circuit board, glue is spread on the contacts of the first circuit board and a front of the line transmission device, and the front of the line transmission device has a bending angle.

14. The card edge cable connector assembly of claim 11, wherein the cover comprises a rectangular frame, the first circuit board is limited inside the rectangular frame, and the cover further comprises a rectangular hole, and the line transmission device is capable of stretching outside via the rectangular hole.

15. The card edge cable connector assembly of claim 11, further comprising: a pulling band positioned on the insulating housing or the cover, wherein the insulating housing comprises a positioning block on a first side, and a pair of guiding blocks on a front end.

16. The card edge cable connector assembly of claim 11, further comprising:

a second circuit board, comprising a card edge portion, a groove, and a positioning portion, wherein the card edge portion comprises a plurality of contacts on a front and a back of the card edge portions, and is capable of being plugged into the plug space of the insulating housing;

wherein the mating portions of the first terminals are capable of electrically connected to the contacts on the front of the card edge portion, the mating portions of the second terminals are capable of being electrically connected to the contacts on the back of the card edge portion, a first side of the insulating housing is capable of being inserted into the groove of the second circuit board, and a positioning block is capable of being secured to the positioning portion of the second circuit board.

17. A card edge cable connector assembly comprising:

an insulating housing, comprising a plurality of first terminal holes, a plurality of second terminal holes, and a plurality of grooves;

a first circuit board, comprising a plurality of first soldering portions, a plurality of second soldering portions, and a plurality of contacts;

a plurality of first terminals, comprising a plurality of vertical roots fastened in the grooves of the insulating housing, and ends of the first terminals are soldered together with the first soldering portions of the first circuit board;

a plurality of second terminals, comprising a plurality of vertical roots fastened in the grooves of the first insulating housing, and ends of the second terminals are soldered together with the second soldering portions of the first circuit board;

a line transmission device, comprising a plurality of conductors electrically connected to the contacts of the first circuit board; and a covering body, positioned in an end of the insulating housing and a front of the line transmission device in an over-molding way;

wherein the insulating housing further comprises a plug space, the first terminal holes are located on a top of the plug space, the second terminal holes are located on a bottom of the plug space, mating portions of the first terminals stretch into the plug space via the first terminal holes, and mating portions of the second terminals stretch into the plug space via the second terminal holes.

18. The card edge cable connector assembly of claim 17, wherein the first terminals and the second terminals are blanking terminals, the vertical roots of the first terminal and the second terminals are fastened in the grooves of the insulating housing by utilizing a pair of reversed spikes, the grooves comprises stretched grooves, and the ends of the first terminals and the second terminals are located in the stretched grooves.

19. The card edge cable connector assembly of claim 17, further comprising: a pulling band positioned on the insulating housing or the cover, wherein the insulating housing comprises a positioning block on a first side, and a pair of guiding blocks on a front end.

20. The card edge cable connector assembly of claim 17, further comprising:

a second circuit board, comprising a card edge portion, a groove, and a positioning portion, wherein the card edge portion comprises a plurality of contacts on a front and a back of the card edge portions, and is capable of being plugged into the plug space of the insulating housing;

wherein the mating portions of the first terminals are capable of electrically connected to the contacts on the front of the card edge portion, the mating portions of the second terminals are capable of being electrically connected to the contacts on the back of the card edge portion, a first side of the insulating housing is capable of being inserted into the groove of the second circuit board, and a positioning block is capable of being secured to the positioning portion of the second circuit board.

* * * * *